US008613171B2

(12) United States Patent
Dudash

(10) Patent No.: US 8,613,171 B2
(45) Date of Patent: Dec. 24, 2013

(54) WINDOW STRUCTURE WITH EXPANSION MEMBER FOR INHIBITING FLOOD WATERS

(75) Inventor: Barbara Dudash, Palm Beach Gardens, FL (US)

(73) Assignee: Deerhill Properties, Inc., Palm Beach Gardens, FL (US)

( * ) Notice: Subject to any disclaimer, the term of this patent is extended or adjusted under 35 U.S.C. 154(b) by 71 days.

(21) Appl. No.: 13/354,007

(22) Filed: Jan. 19, 2012

(65) Prior Publication Data

US 2012/0137603 A1 Jun. 7, 2012

Related U.S. Application Data

(63) Continuation-in-part of application No. 12/577,577, filed on Oct. 12, 2009, now abandoned, which is a continuation-in-part of application No. 12/256,899, filed on Oct. 23, 2008, now abandoned.

(51) Int. Cl.

| | |
|---|---|
| ***E06B 1/60*** | (2006.01) |
| ***E06B 7/098*** | (2006.01) |
| ***E06B 7/26*** | (2006.01) |
| ***E06B 1/62*** | (2006.01) |
| ***E06B 1/34*** | (2006.01) |

(52) U.S. Cl.
CPC .... *E06B 1/62* (2013.01); *E06B 1/34* (2013.01)
USPC ..... 52/213; 52/202; 52/204.599; 52/287.1

(58) Field of Classification Search
USPC ..... 52/101, 202, 204.55, 204.599, 208, 52/213, 214, 215, 232, 287.1, 288.1
See application file for complete search history.

(56) References Cited

U.S. PATENT DOCUMENTS

| | | | |
|---|---|---|---|
| 2,497,515 | A | 2/1950 | Pearse |
| 2,504,204 | A | 4/1950 | Kiefer |
| 2,763,038 | A | 9/1956 | Hagerty et al. |
| 3,377,226 | A | 4/1968 | Renwick |
| 3,500,603 | A | 3/1970 | Strack |
| 3,694,984 | A | 10/1972 | Schwartz |
| 3,796,010 | A | 3/1974 | Carlson |
| 4,178,717 | A | 12/1979 | Sakauye |
| 4,261,584 | A | 4/1981 | Browne et al. |
| 4,473,981 | A | 10/1984 | Simpson |
| 4,611,429 | A | 9/1986 | Kanies |
| 4,660,323 | A | 4/1987 | Kanies |
| 4,699,540 | A | 10/1987 | Gibbon et al. |
| 4,843,763 | A | 7/1989 | Mesnel |
| 5,077,945 | A | 1/1992 | Koeniger |
| 5,615,896 | A | 4/1997 | Morvant |
| 5,722,207 | A | 3/1998 | Anderson et al. |
| 5,943,832 | A | 8/1999 | Russell |

(Continued)

*Primary Examiner* — William Gilbert
(74) *Attorney, Agent, or Firm* — McHale & Slavin, P.A.

(57) ABSTRACT

A flood barrier system for windows for inhibiting a water breach into a residential or commercial structure. The flood barrier is adapted to fit within a retaining wall cavity using an expansion member to assist a mechanical seal so as to stop water intrusion. The barrier operates with an extruded frame having vertical reveal members and high strength glass. A sealing joint is fitted about the retaining wall and the flood barrier's vertical reveal members for inhibition of flood seepage. The sealing joint, having at least three surfaces forming an open end and a tapered end, is anchored at the bottom wall of the extruded frame member and about the glass flood barrier's vertical reveal members at least 12 inches above the base flood elevation level. Alternatively, a flood panel can be installed in front of the windows for additional protection against water intrusion into the residential or commercial structure.

22 Claims, 28 Drawing Sheets

(56) References Cited

U.S. PATENT DOCUMENTS

| | | | |
|---|---|---|---|
| 6,017,038 | A | 1/2000 | Wato et al. |
| 6,253,496 | B1 | 7/2001 | Gilchrist |
| 6,267,383 | B1 | 7/2001 | Morvant |
| 6,318,736 | B1 | 11/2001 | Halling |
| 6,405,498 | B1 | 6/2002 | Riegelman |
| 6,425,707 | B1 | 7/2002 | Baxter |
| 6,460,299 | B1 | 10/2002 | Burrow |
| 6,551,025 | B2 | 4/2003 | Dery |
| 6,681,533 | B1 | 1/2004 | Doyle |
| 6,776,423 | B1 | 8/2004 | Guht |
| 6,895,718 | B2 | 5/2005 | Moffatt |
| 7,128,323 | B2 | 10/2006 | Iguchi et al. |
| 2002/0139060 | A1 | 10/2002 | Contreras et al. |
| 2003/0122325 | A1 | 7/2003 | Aksit et al. |
| 2006/0087114 | A1 | 4/2006 | Yeager et al. |
| 2007/0107355 | A1 | 5/2007 | Campbell |

WINDOW STRUCTURE WITH EXPANSION MEMBER FOR INHIBITING FLOOD WATERS

CROSS REFERENCE TO RELATED APPLICATIONS

This application is a continuation-in-part, and claims the priority date, of U.S. patent application Ser. No. 12/577,577, entitled "Window Structure for Inhibiting Flood Waters", filed Oct. 12, 2009 now abandoned. U.S. patent application Ser. No. 12/577,577 is a continuation-in-part, and claims the priority date, of U.S. patent application Ser. No. 12/256,899, entitled "Window Structure for Inhibiting Flood Waters", filed Oct. 23, 2008 now abandoned, the contents of both applications are incorporated herein by reference.

FIELD OF THE INVENTION

This invention relates generally to flood barriers and, more particularly, to an improvement in window construction that inhibits flood waters from entering a structure by mechanically sealing a properly constructed and engineered window frame to a retaining wall.

BACKGROUND OF THE INVENTION

Floods are common in areas that do not have adequate drainage to handle a high influx of water. Unfortunately, whether an area is susceptible to flooding may change from year to year due to drainage changes as a result of construction, forest growth, river silting, and the like. Further, climate change has made the possibility of a "100 year" flood an event that can now happen in any given year. Unfortunately, it is not possible to predict how much water a flooding event will produce, for the flooding may be caused by upriver snowmelt or rain, locally heavy rainfall, high winds, and similar events that cause water stacking, a drainage malfunction, or the like any of which may cause flood waters to breech a building structure.

Flooding may not damage a building structure but it can be devastating on the contents within the building should water be allowed to enter the structure. The severity of the damage depends not only on the amount of water that accumulates within a building structure in a period of time, but also on the ability of the property owner to quickly remove the water within. Standing water of only an inch deep is sufficient to destroy the contents within the building structure should mold be allowed to take hold.

Most buildings are designed to keep out rain, but they are not necessarily designed to keep out flood water. The news channels are filled with pictures of a community banding together to save the building structures, if not the entire town, by the use of sandbags to redirect flood waters. If the pressure is substantially high or the water level is high enough then loads of water will seep past the sandbags and flood the area. The pressure exerted by the flowing flood water is the difference in water volume. The bigger the difference between the water volume across an area, the greater the force of the movement.

The potential for seepage within a building enclosure is so prevalent and difficult to prevent that the U.S. Army Corps of Engineers in Chapter 7, Section 701.1.1 of the U.S. Army Corps of Engineers 'Flood Proofing Regulations' has specified standards of performance and workmanship in Type 2 Closures in which they allowed "slight seepage" during hydrodynamic and hydrostatic pressure flood conditions in a Special Flood Hazard Zone.

The potential risks from a flood may be mitigated by taking the necessary steps such as causing the structure to resist the flooding. Flood proofing is a combination of adjustments and/or additions of features to individual buildings that are designed to eliminate or reduce the potential for flood damage. Flood proofing techniques can be classified on the basis of type of protection that is provided as follows: Type 1: permanent measures (always in-place, requires no action if flooding occurs); Type 2: contingent measures (requiring installation at the site when flooding occurs); and Type 3: emergency measures (improvised at the site when flooding occurs).

Emergency flood proofing measures include techniques that can be initiated on relatively short notice. Emergency methods to prevent flooding include sandbag dikes, stop log barriers, and earth-fill crib retaining walls. The primary advantage of an emergency method is the relatively low implementation cost. The principle disadvantage of emergency measures is that sufficient advance warning is required to mobilize personnel and install emergency barriers. Most emergency flood proofing methods require extensive labor force, depend on the availability of heavy machinery and trained operators on short notice, and necessitate a large amount of storage space. Furthermore, if the magnitude or the rate of the rise of a flood is misjudged the emergency flood proofing techniques fail. Not to mention aesthetically any emergency flood proofing measure is difficult to bear if left for long periods of time. Another disadvantage is that emergency measures do not satisfy the minimum requirements for watertight flood proofing as set forth by the National Flood Insurance Program for the protection of an existing construction.

Contingent measures such as flood shields and flood walls are watertight barriers designed to prevent the passage of water through doors, windows, or any other opening in a building structure exposed to flooding. Flood shields are usually installed only when flooding is imminent. Normally some type of gasket or seal is required to ensure that the shield is water tight. For example, U.S. Pat. No. 5,943,832, "Flood or Storm Resistant Barriers for Doorways or Window Opening" discloses a frame having two parts, one of the frame parts having portions in telescopic engagement with the other frame part, and a manually operable jack mounted between the two frame parts and operable to move the two frame parts relative to one another to vary an external dimension of the frame and thereby enable the frame to be secured in a doorway or window opening by expansion of the frame into engagement with opposed surfaces of the doorway or window opening. However, the operable jack is exposed to the elements and susceptible to corrosion; this device requires proper maintenance to insure integrity.

U.S. Pat. No. 3,796,010 entitled "Pneumatically Sealable Flood Panel Assembly" discloses a flood panel assembly for installation in doorways to improve water-tight integrity under moderate flood conditions comprising of a conversion frame structure permanently installed into the access opening, and a removable panel arranged to be inserted in the conversion frame and arranged to establish a water-tight association with the conversion frame. The removable flood panel is provided about its edges with an inflatable sealing element, which is normally in a deflated condition. When the flood panel is installed in the conversion frame, it is initially locked in position and the sealing element is thereafter inflated, causing it to expand and provide a water-tight seal. Unfortunately, these flood shield devices are expensive, proper storage is required, and tools are needed for proper installation.

Movable floodwalls consist of a flood barrier which is hinged along the bottom so that it can be lowered to a horizontal position to fit flush with existing ground or pavement. For instance, U.S. Pat. No. 5,077,945 "Doorway Flood Barrier" discloses a doorway mounted flood barrier including a barrier wall having two opposite vertical side edges and a horizontal bottom edge, and retainer means disposed between the barrier wall and lower portion of the doorway for holding the barrier wall sealingly in the lower portion of the doorway. Again, movable floodwall devices are expensive and require proper maintenance.

Permanent flood proofing measures include closures and sealants, and floodwalls and levees. Permanent floodwalls and levees measures are alternatives for protecting a large area or a number of structures, they can be a practical and economical flood proofing technique for protecting single or small groups of structures.

Permanent closure and sealant measures basically involve filling an existing window or opening with some form of water-resistant material such as concrete or sealant. A sealant is a water proof coating that can be applied to the outside of an existing wall to eliminate the wall's permeability. This coating is generally an asphalt-based or polymeric compound that can be painted or sprayed onto the wall. For example, the amount of pressure exerted on a window pane during a flood may be a load the window pane cannot handle. The breached window pane provides a point of entry for wind or water whereby the water enters the building structure and causes severe damage to the infrastructure of the home, upholstery, and furniture and eventually causing sever molding. Therefore, it takes the entire window system to make a seal proof opening within the window cavity. The impact resistant window pane may provide protection from wind, missiles, debris, and water against the window pane but if the frame is not properly installed a load could hit the window pane and cause the entire frame to come off the retaining wall defining a window cavity. Aside from the window pane and frame being susceptible to being struck or blown in by flood water, the gap between the window frame and the retaining wall is especially vulnerable.

Water seeping into the building structure through the area between the frame and retaining wall in which it was installed presents a glaring problem. Caulking is typically performed with a material such as silicone, polyurethane, or polysulfide and is used in filling the gap between the retaining wall and the window frame to eliminate permeability. Caulk has a limited life which is further shortened upon exposure to the elements such as UV light. Caulk that has degraded may become a brittle and lack any ability to prevent water from entering the space between the frame and the structure. Caulk that has minimal shrinkage may appear capable of preventing water passage, however, the shrinkage may create a latent condition wherein the failure occurs when a seal is most important.

Caulk is particularly susceptible to environmental temperature as it expands and contracts leaving potential openings within the gap. During a flood, water pressure builds up on the window frame and if the caulking is brittle the water pressure may be such that it surges pass the caulking and enters the building structure.

U.S. Pat. Nos. 2,497,515, 2,504,204, 3,500,603, 3,694,984, 6,895,718 and U.S. Published Application Nos. 2002/0139060, and 2006/0087114 disclose different methods and compounds for sealing windows and other building structures from the intrusion of water and other undesired elements. U.S. Pat. No. 5,722,207 discloses a metal nail fin or flashing for mounting a window in an opening. U.S. Pat. No. 6,253,796 discloses a gutter retainer.

While these prior art techniques may be suitable for the particular purpose to which they address, they do not present a method of inhibiting flood water entry into a structure about a window frame.

SUMMARY OF THE INVENTION

The disclosed invention is a flood barrier system for window openings. The flood barrier comprises an improved window structure having an extruded frame, a high strength laminated glass panel, a mechanical seal and an expansion member. The extruded frame includes a top wall, a bottom wall, and a set of parallel sidewalls, the inner surfaces of which define a viewing aperture on a horizontal plane. On the sidewalls on the extruded frame is attached the mechanical seal. The glass panel is attached to the front surface of the extruded frame by a gasket and sealant. And should the flood barrier system require further structural support a reinforcement member may be positioned within the extruded frame member. The reinforcement member may extend from the top wall to the bottom wall and intersect the viewing aperture or may extend from one reveal member to the other and intersect the viewing aperture.

The mechanical seal is installed for inhibition of flood seepage. The mechanical seal has at least two surfaces forming an open end and a tapered end. The tapered end of the mechanical seal has two surfaces joined together forming some angle thereinbetween. A mechanical seal is anchored to each of the frame's sidewalls at least 12 inches above the base flood elevation level and abuts the window opening. And another mechanical seal is anchored to the frame's bottom wall and abuts a floor on the window opening.

Expansion of the mechanical seal may occur upon a force being received within the open end of the mechanical seal and exerted on the tapered end of the mechanical seal. When the mechanical seal expands the mechanical seal wedges further between the window opening and the frame for inhibition of flood seepage. In addition, the use of an expansion member will force the mechanical seal into position. It is recognized that many years may pass before a flood condition occurs, and the mechanical seal may have taken on an aged set. The use of an expansion member will assure that the mechanical seal is tightly sealed to the structure to prevent water passage.

Accordingly, it is an objective of the present invention to provide a flood barrier system for first floor windows where the property owner need not have to perform regular maintenance or perform manual labor in preparation for a disaster to protect the building contents. Alternatively, the flood barrier system may be installed from the ground floor for building structures in coastal areas erected on stilts.

It is a further objective of the present invention to provide a flood barrier system for windows that is hydrostatic pressure resistant. The flood barrier conforms to the criteria for resisting lateral forces due to hydrostatic pressure from freestanding water as set forth by FEMA.

It is an objective of the present invention to provide a flood barrier system that is capable of resisting a 1000 lb. object at minimum velocity of 8 ft/sec as set forth by FEMA.

It is an objective of the present invention to provide a flood barrier system satisfying the flood certificate requirements set forth by the National Flood Insurance Program developed by FEMA for use in certification of non-residential flood proofing designs.

It is an objective of the present invention to provide a flood barrier system whereby the mechanical seal is memory shaped to expand when a force is introduced therethrough and return a substantially original position, and the use of an expansion member will create a seal when the expansion member is wetted.

It is an objective of the present invention to provide a flood barrier system where the viewing aperture may contain a vertical or horizontal mullion structures or any combination thereof within the viewing aperture. The mullion structures form a grid-like pattern producing a plurality of viewing openings within the viewing aperture.

It is an objective of the present invention to provide a glass flood barrier system that can be adapted to any building opening comprising of existing slabs and walls openings capable of supporting a flood before the flood barrier system is installed.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
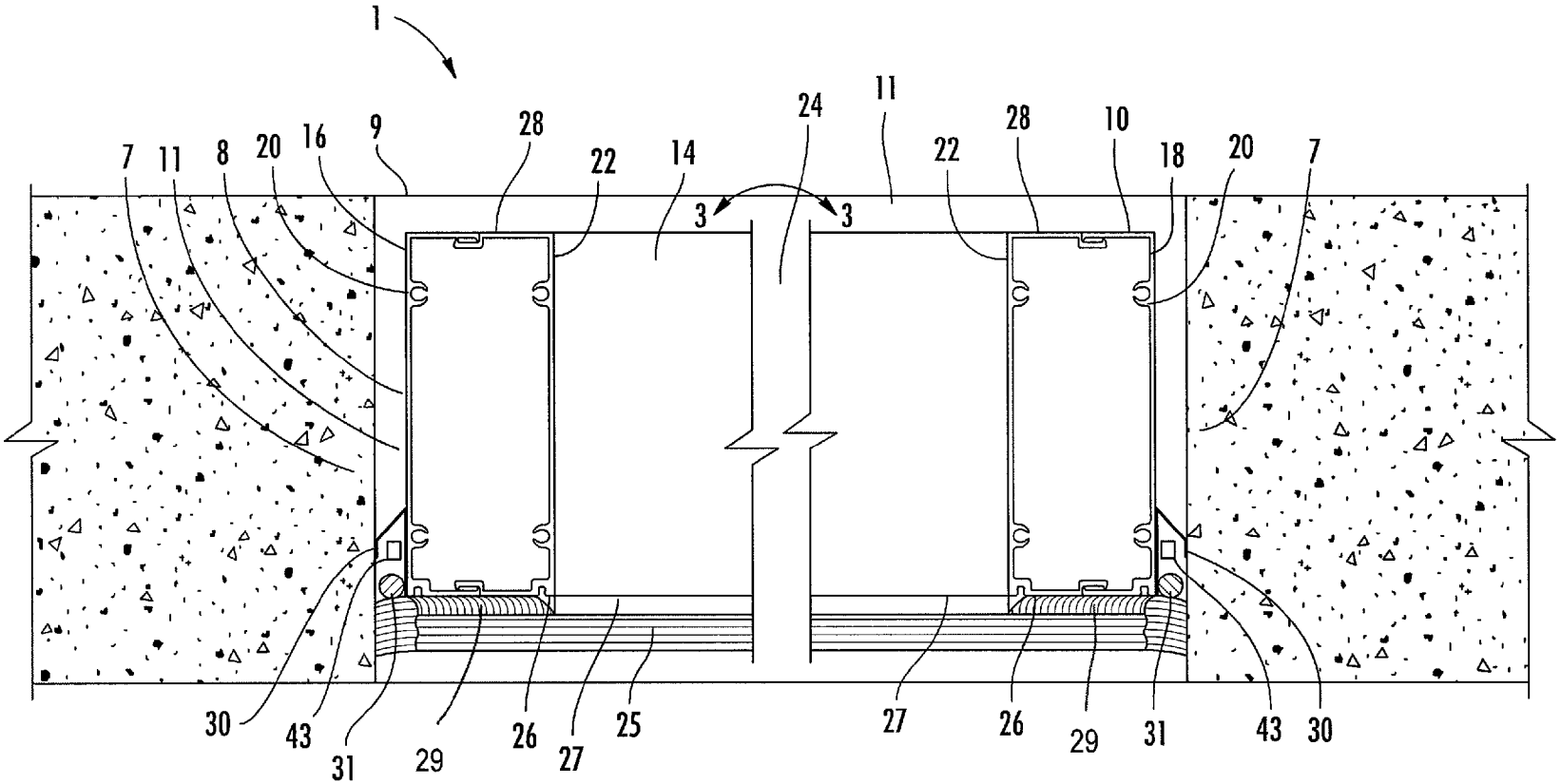
FIG. 1 is a cross sectional top view of the present invention.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring now to FIGS. 1-30, wherein like components are numbered consistently throughout, an improvement in window construction, herein known as a flood barrier system 1. The system 1 illustrated in FIGS. 1-2 comprises of a frame member 10 and a mechanical seal 30, the words used interchangeably in this application. The flood barrier system 1 is constructed to adapt into a cavity or window opening 11 in a building structure. The frame 10 includes a top wall 12, a bottom wall 14, and two substantially parallel sidewalls 16 and 18. The sidewalls 16 and 18 are typically known in the art as vertical reveal members 16 and 18. The frame 10 further has an outer surface 20 sized for placement within a window opening 11 of a building structure and an inner surface 22 defining a viewing aperture 24. The frame also includes a front surface 26 positioned toward an exterior of the building structure and a back surface 28 positioned toward an interior of the building structure. The viewing aperture 24 is on a horizontal plane therein between the inner surface 22 of the reveal members 16 and 18, and the inner surfaces 22 of the top wall 12 and bottom wall 14. Preferably, each member comprising the frame 10 (top wall 12, bottom wall 14, and reveal members 16 and 18) be constructed of extruded aluminum. However, to provide greater structural integrity rigid cross members may be positioned therein the extruded members to provide structural support (not shown).

Figure 3:
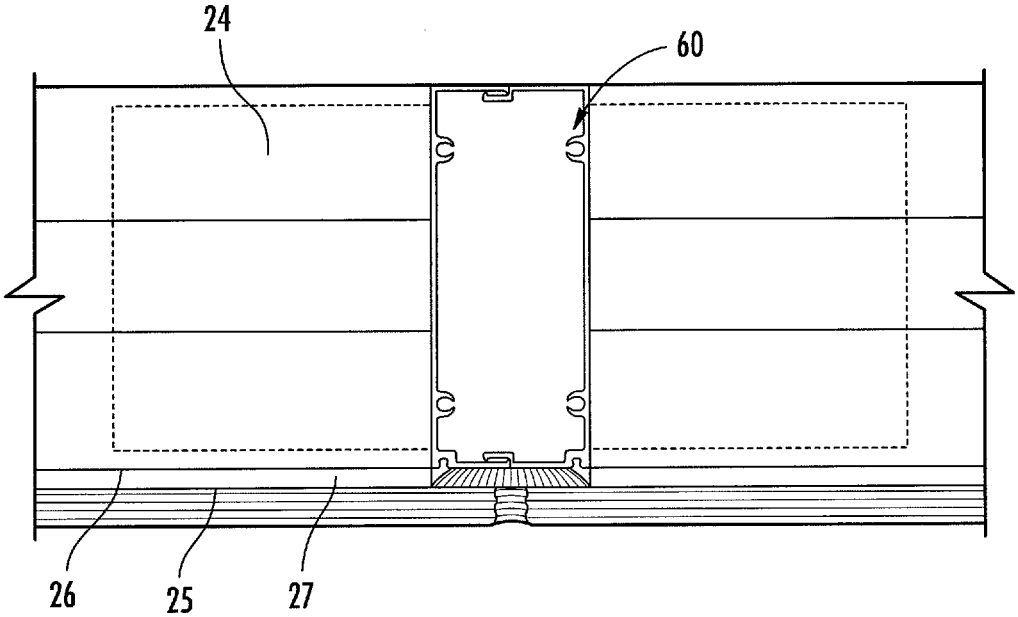
FIG. 3 is a cross sectional top view alternative embodiment of the viewing aperture the present invention.

Should the flood barrier require further structural support, a reinforcement member 60 may be positioned within the extruded frame 10. As shown in FIG. 3, the vertical reinforcement member 60 extends from the top wall 12 to the bottom wall 14 and intersects the viewing aperture 24. More specifically, the vertical reinforcement member 60 is positioned between the reveal members 16 and 18 of the frame 10, traversing the viewing aperture 24, and intersecting the top wall 12 and bottom wall 14 of the frame 10. The vertical reinforcement member 60 attaches to the inner surface 22 of the top wall 12 and the bottom wall 14 or the vertical reinforcement member 60 may traverse the top wall 12 and the bottom 14 up to the outer surface 20. Alternatively, a horizontal reinforcement member 60 may be positioned within the extruded frame 10 extending from one reveal member 16 to an opposite reveal member 18 and intersecting the viewing aperture 24 (not shown). More specifically, the horizontal reinforcement member 60 is positioned between the top wall 12 and bottom wall 14 of the frame 10, traversing the viewing aperture 24, and intersecting the reveal members 16 and 18 of the frame 10. The horizontal reinforcement member 60 attaches to the inner surfaces 22 of each reveal member 16, 18. Preferably, the reinforcement member 60 is constructed of extruded aluminum.

Figure 2:
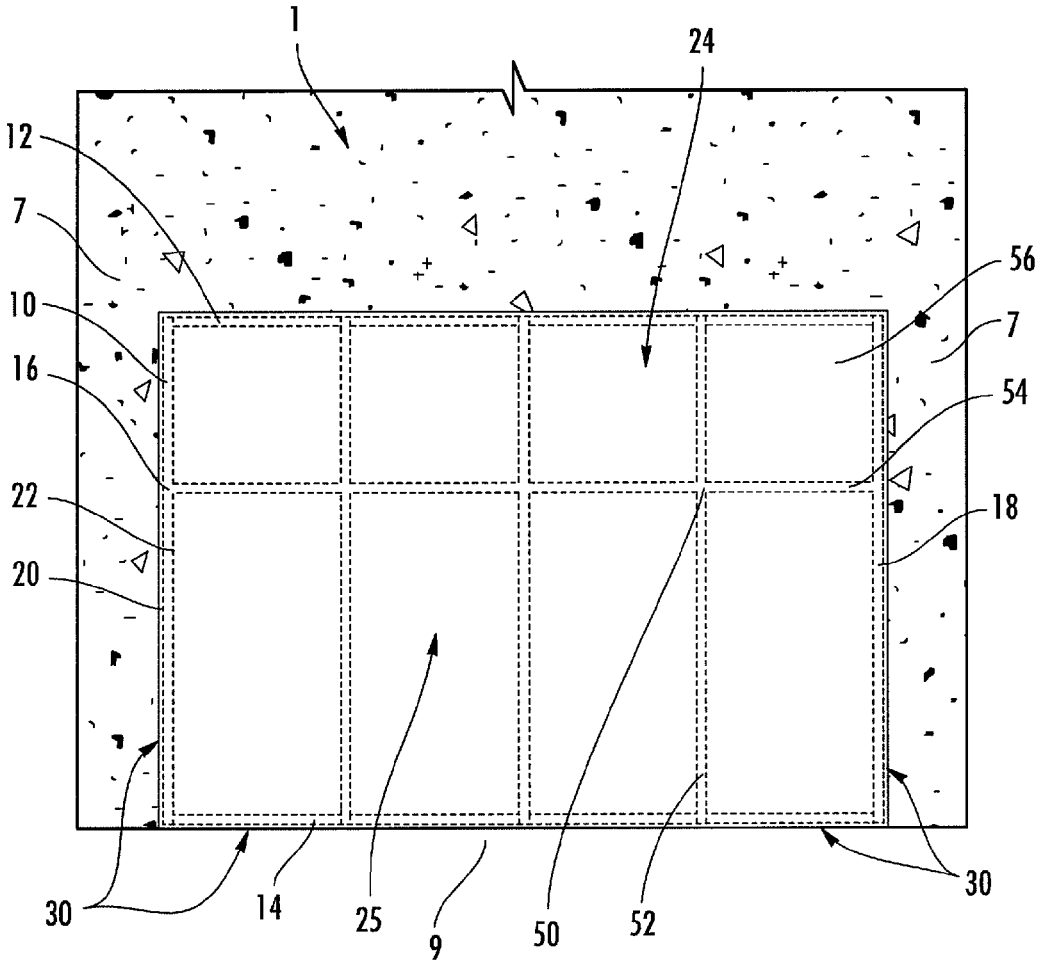
FIG. 2 is a front view of the present invention.

As shown in FIGS. 1-2, along the front surface 26 of the frame 10 is attached a glass panel 25. In the preferred embodiment, the glass panel 25 is a high impact glass and should be a minimum of 9/16 inches in thickness to provide sufficient impact resistance. The attachment means of the high strength glass 25 to the front surface 26 of the frame 10 includes a gasket 27 and a water resistant sealant 29. Laminated high impact glass panel 25 is preferred because should the glass break, the laminate serves to keep the glass fragments in place, whereas when a single glass pane is used without a laminate and the glass breaks water penetrates within. The high strength laminated glass panel 25 must have the structural capacity to resist forces imposed by flood waters because the majority of the surface area of the flood barrier system 1 that resists the forces of the flood water is taken up by the high strength laminated glass panel 25.

Furthermore, as shown in FIG. 2 the viewing aperture may contain at least one mullion member 50. The mullion members 50 are vertical structures 52 and horizontal structures that divide the viewing aperture 24 into smaller viewing opening 56 forming a grid-like pattern. The vertical mullion structures 52 extend from the inner surface 22 of the top wall 12 to the inner surface 22 of the bottom wall 14 on the frame 10. The horizontal mullion structures 54 extend from the inner surface of one reveal member 16 to the inner surface of an opposite reveal member 18. If a vertical reinforcement member 60 is used with the flood barrier system 1 then the horizontal mullion structure 54 extends from the inner surface 22 of a reveal member 16 and 18 on the frame 10 to an outer surface of a sidewall on the reinforcement member 60 (not shown). If a horizontal reinforcement member 60 is used with the flood barrier system 1 then the vertical mullion structure 52 extends from the inner surface 22 of the top wall 12 or the bottom wall on the frame 10 to an outer surface of a sidewall on the reinforcement member 60 (not shown).

Because of building tolerances and imperfections there are typically gaps 8 left thereinbetween the frame 10 and the window opening 11. To inhibit a breach within the gaps 8 a mechanical seal 30 is positioned at the bottom wall 14 of the frame 10 and the floor 9 of the window opening 11, and about the frame's reveal members 16 and 18, up to 12 inches above the base flood elevation level as set forth by FEMA and the window opening 11, as shown in FIGS. 1-2. The window opening 11 generally consists of two sets of substantially parallel structures, known herein as retaining walls. Abutting the uppermost parallel structure on the window opening 11 is the top wall 15 of the frame 14, abutting the lowermost parallel structure (or floor 9) on the window opening 11 is a horizontally oriented mechanical seal 30, and abutting the two remaining parallel structures 7 on the window opening 11 are vertically oriented mechanical seals 30. The mechanical seals 30 inhibit the passage of wind, missiles, debris, and water into the building structure. For installation purposes, the glass panel 25 and mechanical seals 30 are anchored to the frame 10 before the flood barrier system 1 is placed within the window opening 11.

Each vertically oriented mechanical seal 30 extends to a height of up to 12 inches above the base flood elevation level as set forth by FEMA. The base flood elevation level is defined as the elevation (normally measured in feet above sea level) that the base flood is expected to reach as determined by FEMA. The vertically oriented mechanical seal 30 is secured to the outer surface 20 of the reveal members 16 and 18. The horizontally oriented mechanical seal 30 extends along the floor of the window opening 11 from one retaining wall 7 on the window opening 11 to the opposite retaining wall 7 on the window opening 11. The horizontally oriented mechanical seal is secured to the bottom wall 16 of the frame 14 (not shown).

Figure 4A:
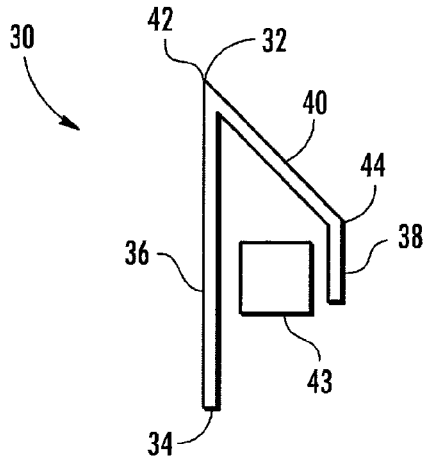
FIG. 4A is an end view of a V-shaped mechanical seal of the present invention having an expansion member.
Figure 4B:
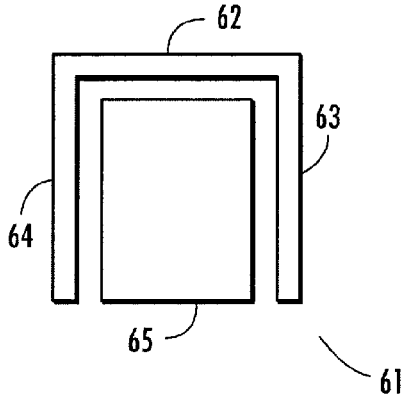
FIG. 4B is an end view of a U-shaped mechanical seal of the present invention having an expansion member.
Figure 5:
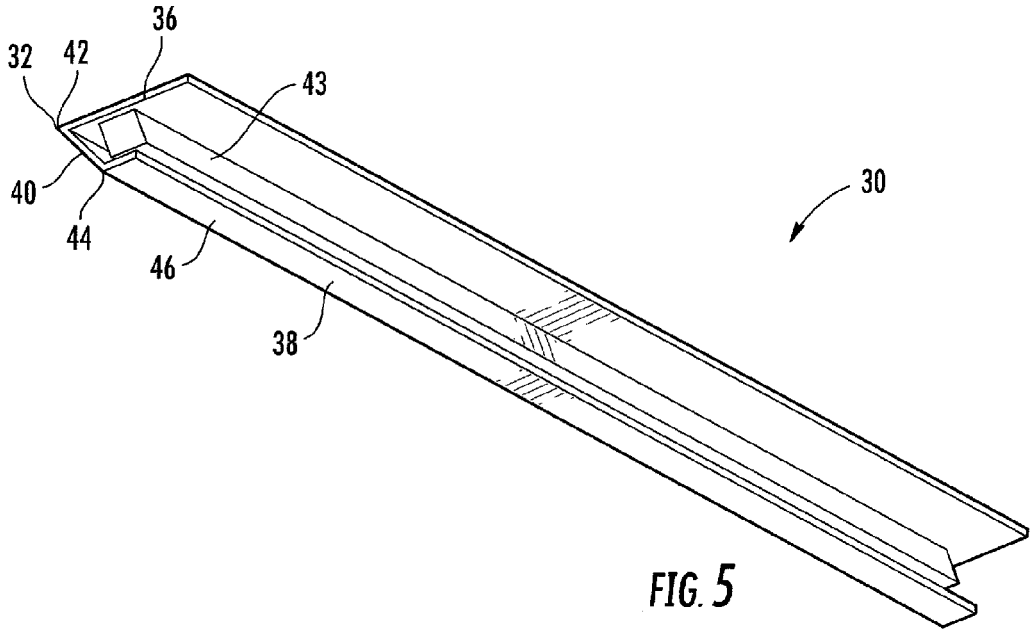
FIG. 5 is a perspective view of the mechanical seal of the present invention.

FIGS. 4A, 4B, and 5 illustrate the mechanical seal 30. The mechanical seal 30 has a tapered end 32 and an open end 34. The open end 34 is facing the exterior of the building structure and the tapered end 32 is facing the interior of the building structure as illustrated in FIGS. 1-2. The mechanical seal 30 shown is substantially V-shaped; however, it is contemplated that the mechanical seal may be U-shaped or J-shaped. The mechanical seal 30 comprises of three surfaces. The first surface 36 of the vertically oriented mechanical seal 30 abuts each outer surface 20 of the reveal member 16 and 18 and the first surface 36 horizontally oriented mechanical seal 30 abuts the outer surface 20 of the frame's bottom wall 14. The first surface 36 has one end terminating at the open end 34 and opposite end terminating at the tapered end 32 and connecting to a second surface endpoint 42. The third surface 38 of the vertically oriented mechanical seal 30 abuts the vertical parallel building structural walls 7 on the window opening 11 and the third surface 38 on the horizontally oriented mechanical seal 30 abuts the floor 9 on the window opening 11. The third surface 38 has one end terminating at the open end 34 and opposite end of the third surface 38 connecting to a second surface endpoint 44. The first surface 36 and third surface 38 are substantially parallel to each other forming an original position. The second surface 40 has two endpoints, 42 and 44. The first endpoint 42 terminates at the opposite end of the first surface 36. This intersection of the first and second surface is the tapered end 32 of the joint 30. The first surface 36 and the second surface 40 form an angle thereinbetween. The second endpoint 44 of the second surface 40 terminates at the opposite end of the third surface 38. The third surface 38 does not extend beyond the length of the first surface 36.

Figure 6:
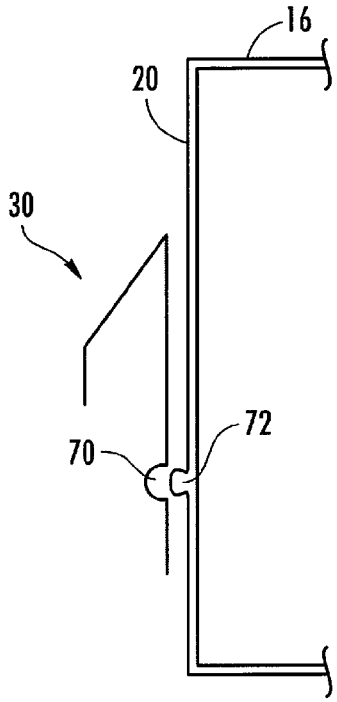
FIG. 6 is top view on a first embodiment of mechanical seal securement.
Figure 7:
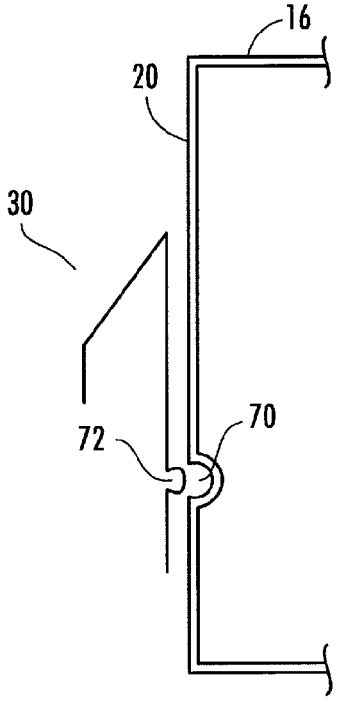
FIG. 7 is top view on a first embodiment of mechanical seal securement.
Figure 8:
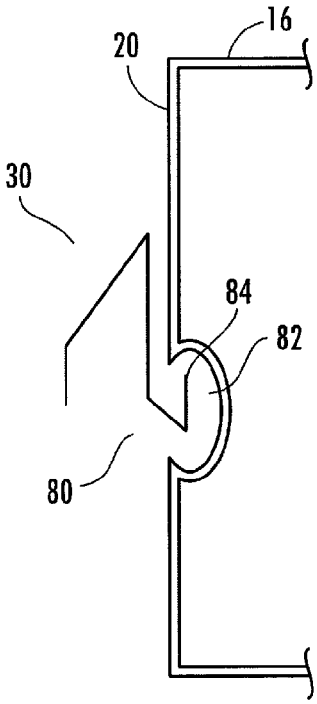
FIG. 8 is top view on a first embodiment of mechanical seal securement.
Figure 9:
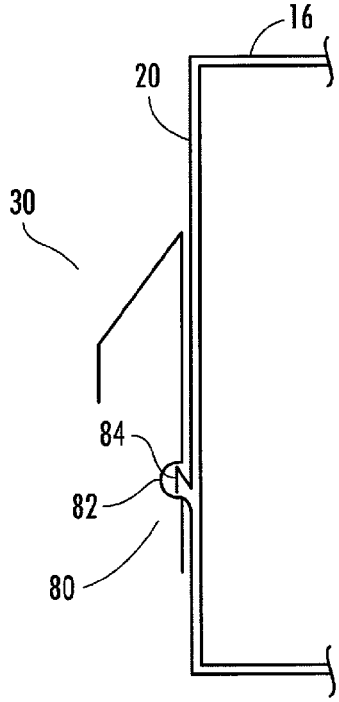
FIG. 9 is top view on a first embodiment of mechanical seal securement.

To secure the mechanical seal 30 to the frame 10 various methods may be employed, as shown in FIGS. 6-9. The following methods are exemplary and should not be held as limiting. One method of securement includes water resistant sealant, such as caulking, on the exterior surface 46 of the mechanical seal 30 between the first surface 36 of the mechanical seal 30 and frame members 16 and 18. Another method for securement of the mechanical seal 30 to the frame 10 includes fasteners such as rivets, stainless steel metal screws, or the like. Also contemplated are securement means such as an extruded raceway 70, a snap lock fastener 80, or a wedge ramp lock. As shown in FIG. 7, an extruded raceway 70 allows for slidable engagement of the mechanical seal 30 into the frame 10 or slidable engagement of the frame 10 into the mechanical seal 30 using a stem 72 and a corresponding extruded raceway 70. The extruded raceway 70 is formed integral with the frame 10, more particularly the outer surface 20 of the reveal member 16 and 18, allowing slidable engagement of the mechanical seal 30 having a stem 72. The stem 72 is slidably insertable into the extruded raceway 70 on the frame 10. Or as shown in FIG. 6, the extruded raceway 70 is formed integral with the mechanical seal allowing slidable engagement of the frame 10, more particularly the outer surface 20 of the reveal member 16 and 18, having a stem 72. The stem 72 is slidably insertable into the extruded raceway on the mechanical seal 30. The snap-lock fasteners includes various embodiments, and should not be limited to the embodiment described, such as a self-locking standing seams 80 shown in FIGS. 8 and 9, whereby the frame 10 has a seam 82 for receiving the locking stem 84 on the mechanical seal 30, or where the mechanical seal 30 has a seam 82 for receiving the locking stem 84 on the frame 10. Although the methods described above are for securement of the mechanical seal 30 to the frame 10, it is contemplated that the same may be used to secure the mechanical seal 30 to the window opening 11.

Upon the occurrence of a disaster, a force is exerted upon the mechanical seal 30. This force is usually hydraulic pressure from flood waters. The force is received within the open end 34 of the mechanical seal 30 until it reaches the tapered end 32. If the force is substantial the joint 30 will expand nominally. Thus the first surface 36 and the third surface 38 will no longer be substantially parallel. However, there will not be a breach because the first surface 36 and the third surface 38 remain abutting the outer surface 20 of the reveal members 16 and 18 or the outer surface of the bottom wall of the frame 10 and the window opening 11, respectively. Thus, both the vertically oriented and horizontally oriented mechanical seals provide a watertight seal between the window and the structural walls of the building. This watertight seal prevents water from entering the building. The mechanical seal is memory shaped and is thus constructed of spring steel, aluminum, plastic, or the like. The mechanical seal 30 is memory shaped so that when a force is no longer acting the mechanical seal 30 it may substantially return to an original position whereby the first surface 36 and third surface 38 are substantially parallel, although this is not necessary and will not affect the mechanical seals performance.

As shown in FIGS. 1-3, a water resistant sealant 31 is position at the open end 34 of the sealing joint 30. Water resistant sealants such as silicone, etha-foam rod, expanded foam, rubber, closed cell foam, foam filler, or the like may be used. Additionally, between the terminating edge of the high strength glass panel 25 and the window opening 11 another water resistant sealant means 31 is applied. These seals are used to create a water tight barrier between the glass and the panel. An expansion element 43 is secured to the mechanical seal. The expansion element expands upon the presence of flood waters creating a both a seal and causing an expansion of the mechanical seal for enhanced engagement of the mechanical seal to the structure and to the frame. The mechanical seal 30 is substantially V-shaped having an a first surface 36, a second surface 38 and a third surface 40 forming an open end 34. The expansion element is secured to the mechanical seal by adhesive or fastener. In the preferred embodiment, the expansion element is constructed from hydrophilic polyurethane capable of expanding at least 100% its non-wetted size. In the preferred embodiment, the wetting of the polyurethane expansion element causes an opening of the seal between the frame and the structure to its full range. Hydrophilic properties used in the instant invention is preferably capable of forming a waterproof barrier but not a requirement, the objective of the expansion element is to cause the mechanical seal to expand to its fullest position thereby forcing the mechanical seal to perform its intended function but also to create a wedge type fit with the mechanical seal to prevent a pressure blow-out due to the weight of the flood water. The expansion joint providing reinforcement to any existing fastener or creating a friction fastener when needed. The expansion element may include an adhesive in the compound allows for a fastenerless attachment, or the expansion element may be attached to the mechanical seal by screws, rivets or any other type of fastener capable of maintaining the element in position. It should be noted that the expansion element can be of any shape or size, or made of other materials with the objective of the invention to cause the expansion of the mechanical seal for proper sealing during an emergency.

It is recognized that a flood may not take place for years, if ever, after the installation of the expansion element and mechanical seal. For this reason it is important that the expansion element is maintained in position despite both heat and cold temperature changes. The hydrophilic polyurethane can be made of a porous material that has poor water seal ability, the need for the expansion element is to expand the shape of the mechanical seal when needed. Over time the mechanical seal may have tempered its ability to maintain a particular shape especially when the mechanical seal is subjected to both temperature and age.

The use of a rigid mechanical seal requires the seal to create the joint with the mechanical seal operating as a holder to the expansion element. A flexible seal is preferred, especially a seal capable of maintaining a memory shape. The mechanical seal may also employ a substantially U-shape housing 61, as illustrated in FIG. 4B, having a mounting wall 62 and a first support wall 63 and a second support wall 64 extending perpendicular thereto. In this embodiment the expansion element is secured between the first and second support wall. The mechanical seal can be formed from a material as rigid as extruded aluminum, malleable as spring steel or even from a flexible material such as plastic. Although aluminum is preferred material of construction, it is contemplated that the frame 14, and reinforcement member 60, and mullion structures 50 may also be constructed of composite materials, fiberglass, and various composite plastics including polypropylene and polyethylene. Thus, both the vertically oriented and horizontally oriented mechanical seals together with the expansion element provide a watertight seal between the window and the structural walls of the building. This watertight seal prevents water from entering the building.

Figure 10:
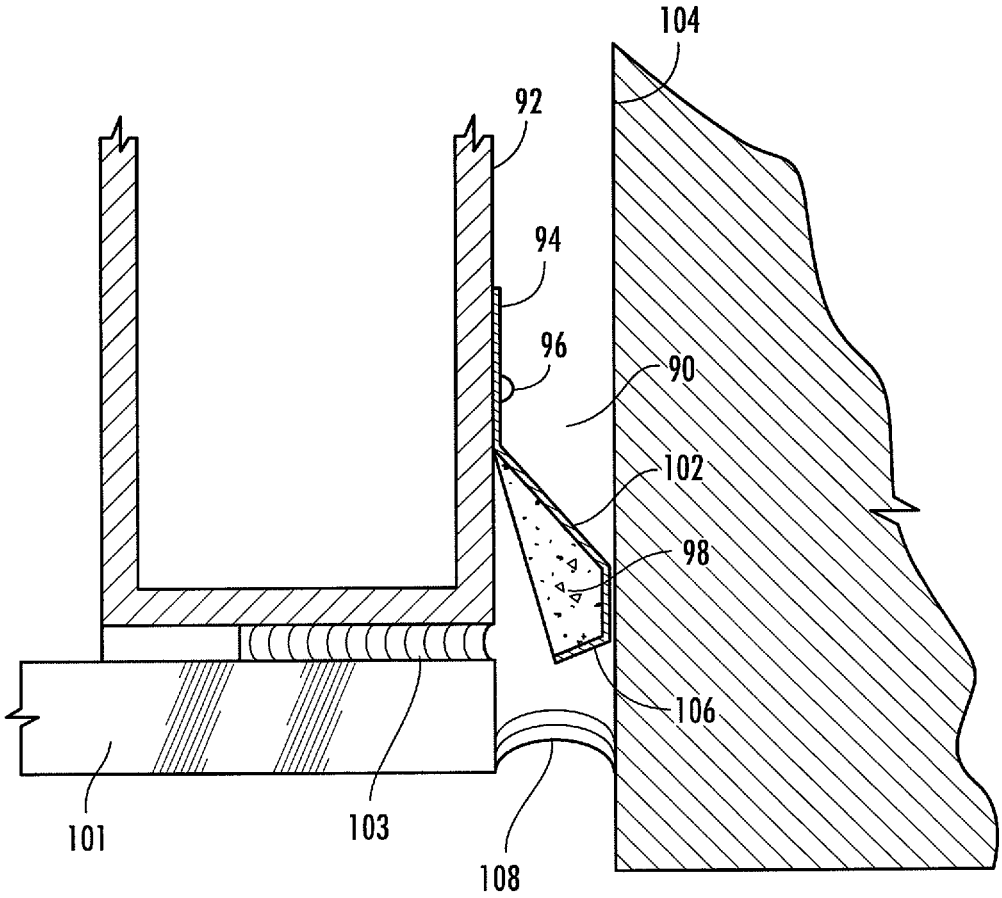
FIG. 10 is an alternative embodiment of the mechanical seal and expansion member.

Referring now to FIG. 10, set forth is an alternative embodiment illustrating a mechanical seal 90, which is secured to a frame 92. The mechanical seal 90 has a mounting end 94, secured to the frame by fastener 96. The mechanical seal 90 maintains the polyurethane based expansion element 98 within an element holder 102. Upon the wetting of the expansion element, the element holder 102 is forced against the structural wall along surface 106 creating a watertight seal between the frame and the structural wall. The shape of the element holder further operates as a dam wherein an increase in water pressure due to flood waters further forces the element holder against the structural wall.

The system in this embodiment is protected from normal environmental elements by the use of a construction sealant 108. The construction sealant works in its normal manner and will inhibit sunlight from degrading the expansion element, as well as normal moisture from causing a wetting of the expansion element. However, a construction sealant is not capable of withstanding the pressure of flood water wherein leakage of water past the sealant will engage the expansion element and create the flood barrier at the necessary time. It should be noted that simply filling in the space between the frame and the structural wall with an expansion element will not provide the structural reinforcement necessary in holding the expansion element in place when a water pressure is introduced. Further, the use of a mechanical seal in combination with an expansion element allows for a directional outflow of the expanded material in a predetermined direction to provide an intended result, even if the expansion element has been left dormant for many years. The use of impact glass 101 is required so as to withstand the water pressure of a flood and expected floating debris. The use of an adhesive 103 between the window glass 101 and the frame 92 is a standard practice, the use of an adhesive causing a bonding to the frame and wind, creating a water proof entry.

The expansion element has a swelling capacity, wherein a wetted expansion element swells in size at least 100% over a non-wetted expansion element. Such materials can swell over 500% in size, the objective of the expansion joint is to size the frame properly so that the expansion seal operates within its range of expansion. As previously mentioned, the preferred material is polyurethane.

Figure 11:
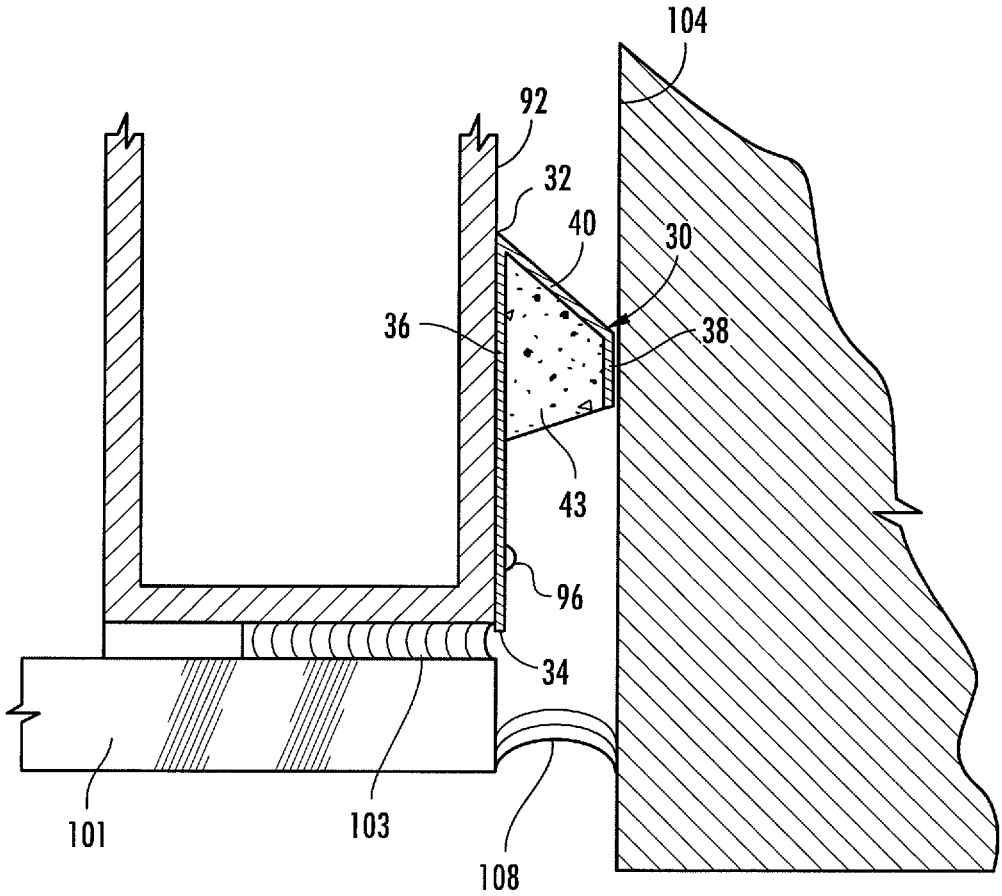
FIG. 11 is an embodiment of the mechanical seal and expansion member also shown in FIG. 4A.

Referring now to FIG. 11, set forth is another embodiment illustrating a mechanical seal 30, also illustrated in FIG. 4A which is secured to a frame 92. The mechanical seal 30 has a tapered end 32 and an open end 34. The open end 34 is facing the exterior of the building structure. It should be noted that construction sealant 108 can be used as a primary seal for protecting the mechanical seal 30 from the elements. For instance, the construction sealant may hold back rainwater and sunlight for years, thus preventing dirt from entering the space between the frame and the building. However, the sealant may become brittle and unable to withstand the pressure from flood water. In this manner the expansion element stands ready to create a seal when necessary. The mechanical seal is secured to the frame by fasteners 96. The mechanical seal shown is substantially V-shaped having a first surface 36 which abuts each outer surface of the frame 92 or reveal member. A second surface endpoint 32 and a third surface 38 which abuts the vertical structural wall of the building opening 104.

Upon the wetting of the expansion element 43, the mechanical seal is opened and forced against the structural wall creating a watertight seal between the frame and the structural wall. The shape of the element holder further operates as a dam wherein an increase in water pressure due to flood waters further forces the element holder against the structural wall.

As with the previously described embodiments, the expansion element 43 has a swelling capacity, wherein a wetted expansion element swells in size at least 100% over a non-wetted expansion element. Such materials can swell over 500% in size, the objective of the expansion joint is to size the frame properly so that the expansion seal operates within its range of expansion.

Figures 12A, 12B, 12C:
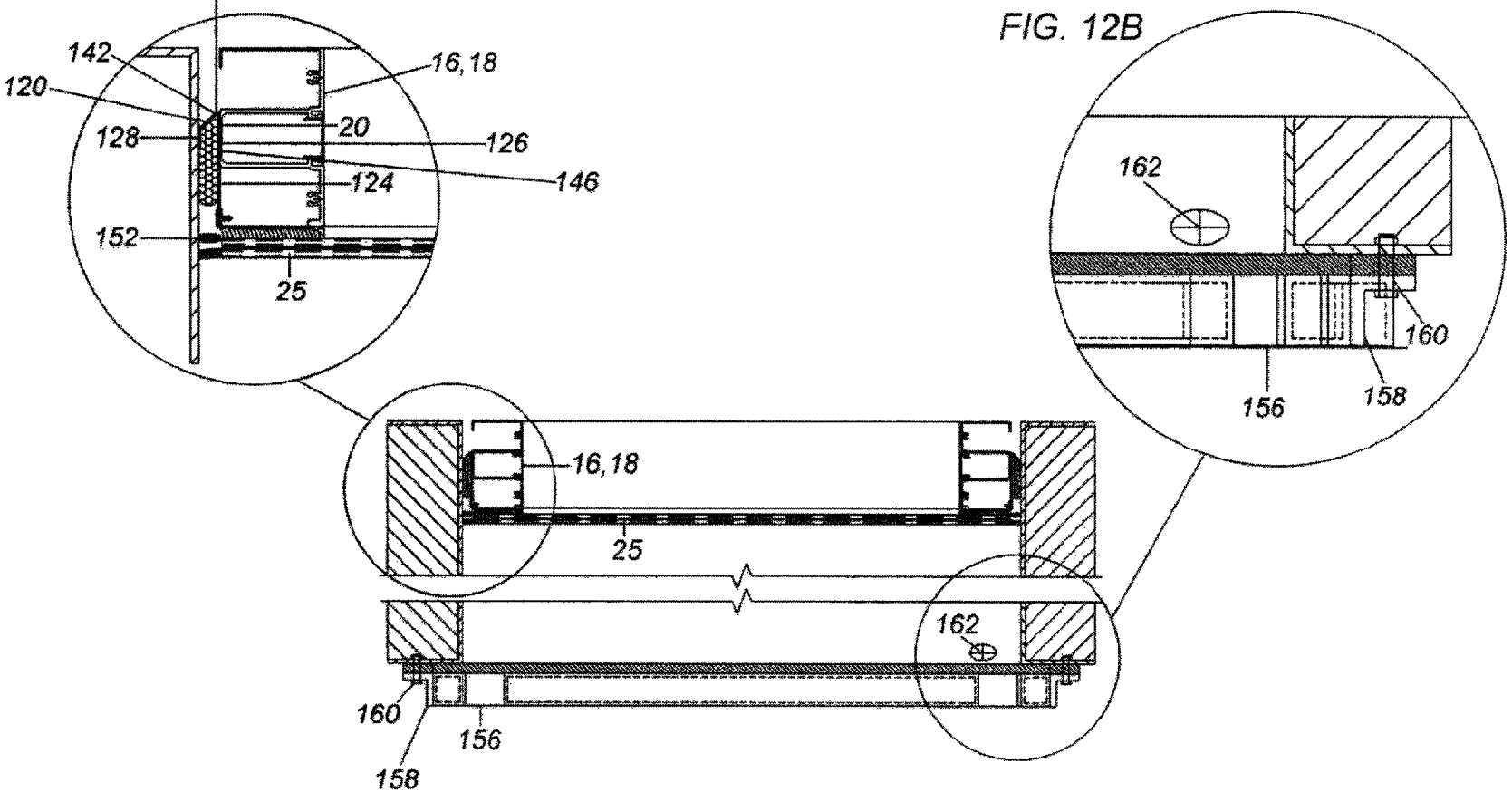
FIG. 12A is a top sectional view of an alternative embodiment of the present invention including an exterior flood panel.
FIG. 12B is a sectional view within the circle in FIG. 12A.
FIG. 12C is a sectional view within the circle in FIG. 12A.
Figure 13:
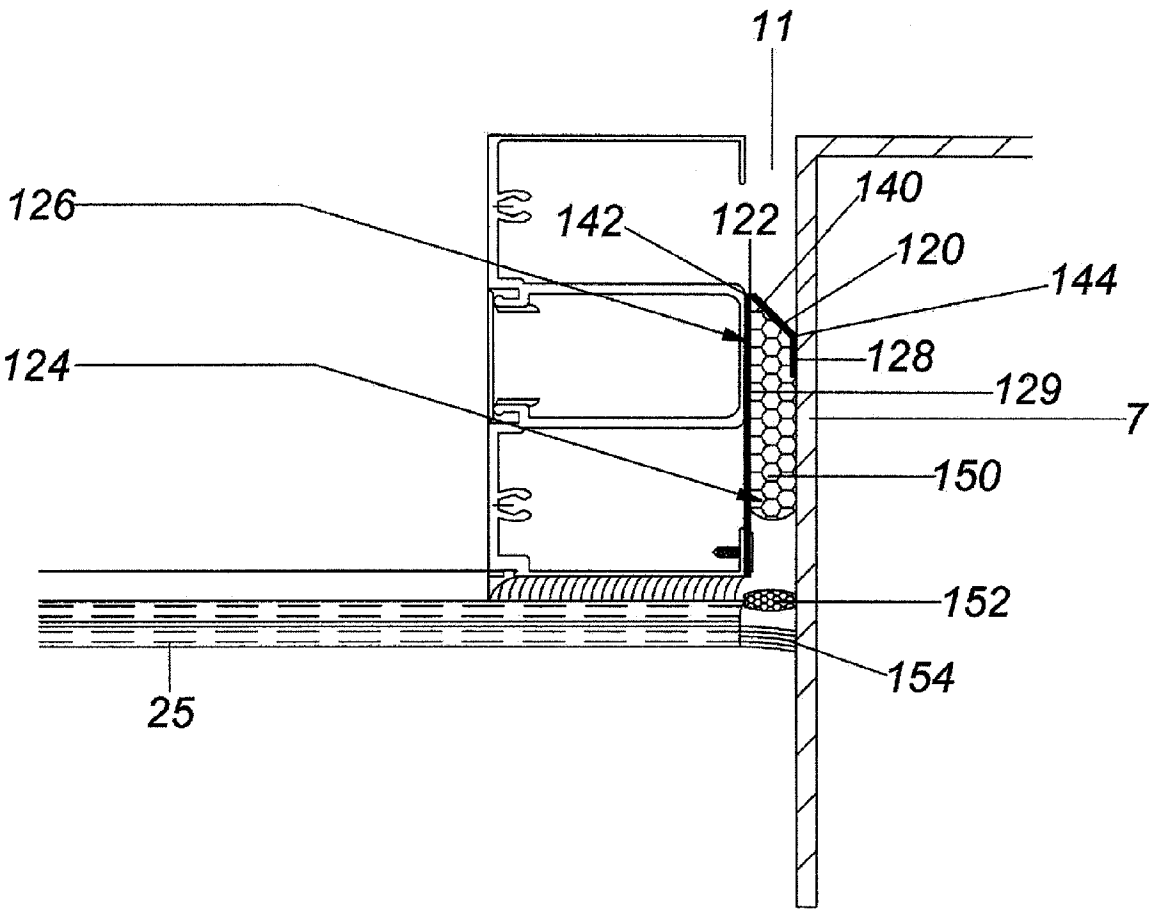
FIG. 13 is a detailed view of the dynamic flood seal in FIG. 12C on an opposite side of a window.

Referring now to FIGS. 12A-C, 13, and 14, set forth is another embodiment illustrating a further embodiment of the mechanical seal 90. In FIGS. 12A-C and 13 a dynamic seal 120 is similar to seal 90 but functions in a different manner. FIGS. 12A, 12C, and 13 illustrate the dynamic mechanical seal 120. The dynamic mechanical seal 120 has a tapered end 122 and an open end 124. The open end 124 is facing the exterior of the building structure and the tapered end 122 is facing the interior of the building structure as illustrated in FIGS. 12A, 12C, and 13. The dynamic mechanical seal 120 shown is substantially V-shaped; however, it is contemplated that the mechanical seal may be U-shaped or J-shaped. The dynamic mechanical seal 120 comprises of three surfaces. The first surface 126 of the vertically oriented dynamic mechanical seal 120 abuts each outer surface 20 of the reveal member 16 and 18 and the first surface 126 horizontally oriented mechanical seal 120 abuts the outer surface 20 of the frame's bottom wall (not shown). The first surface 126 has one end terminating at the open end 124 and opposite end terminating at the tapered end 122 and connecting to a second surface endpoint 142. The third surface 128 of the vertically oriented dynamic mechanical seal 120 abuts the vertical structural walls 7 on the window opening and the third surface 128 on the horizontally oriented dynamic mechanical seal 120 abuts the floor 9 on the window opening 11 (FIG. 2). The third surface 128 has one end terminating at the open end 129 and opposite end of the third surface 128 connecting to a second surface endpoint 144. The first surface 126 and third surface 128 are substantially parallel to each other forming an original position. The second surface 140 has two endpoints, 142 and 144. The first endpoint 142 terminates at the opposite end of the first surface 126. This intersection of the first and second surfaces is the tapered end 122 of the dynamic mechanic seal 120. The first surface 126 and the second surface 140 form an angle there between. The second endpoint 144 of the second surface 140 terminates at the opposite end of the third surface 128. The third surface 128 does not extend beyond the length of the first surface 126.

To secure the dynamic mechanical seal 120 to the frame 10 various methods may be employed. The following methods are exemplary and should not be held as limiting. One method of securement includes water resistant sealant, such as caulking, on the exterior surface 146 of the dynamic mechanical seal 120 between the first surface 126 of the dynamic mechanical seal 120 and frame members 16 and 18. Another method for securement of the dynamic mechanical seal 120 to the frame 10 includes fasteners such as rivets, stainless steel metal screws, or the like. Also contemplated are securement means such as an extruded raceway, a snap lock fastener, or a wedge ramp lock.

Further seals and systems to prevent the intrusion of water into a building are illustrated in FIG. 13. A foam waterproofing material 150 is contained within and secured to the dynamic mechanic seal 130. This material is similar in function to the expansion element 43. The waterproofing material 150 expands upon installation into the seal 120 and/or frame creating a both a seal and causing an expansion of the dynamic mechanical 120 seal for enhanced engagement of the dynamic mechanical seal 120 to the structure and to the frame. Upon expansion of the dynamic mechanic seal 120 the first and third surfaces, 126 and 128, are no longer parallel to each other, since they are pressed into the revel members 16, 18 and the structural walls 7 of the window opening 11. The presence of flood waters within the dynamic mechanic seal 120 also expands the dynamic mechanical seal 120 further increases the hydraulic pressure of the first and third surfaces, 126 and 128, against the revel members 16, 18 and the structural walls 7 of the window opening 11. This increased hydraulic pressure further assists in providing a watertight seal between the window and the window opening and preventing floor waters from entering the building or structure. Calking 152 and 154 are also employed to prevent water from entering the building around the window.

Figure 14:
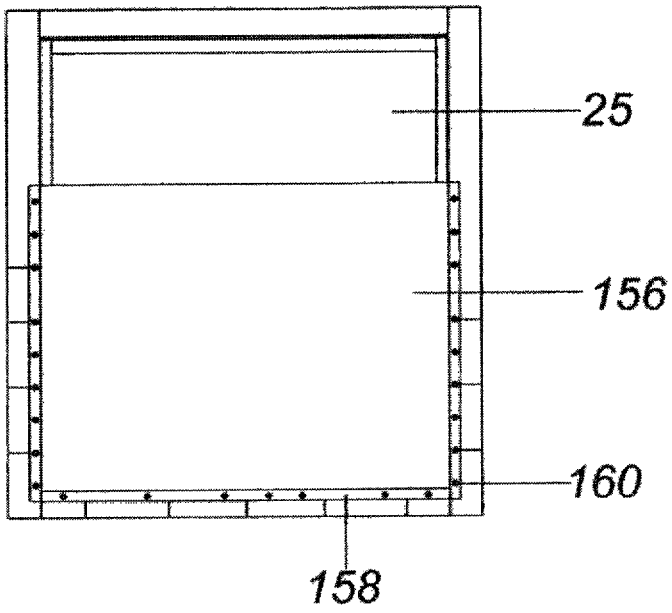
FIG. 14 is a front view of the embodiment in FIG. 12A including the flood panel.

A further feature of the embodiment illustrated in FIGS. 12A-C, 13 and 14 is the flood panel 156. As shown in FIGS. 13A and 14, the flood panel 156 is secured to the outside of the front of the window by brackets 158 and fasteners 160 to form a substantially watertight barrier between the outside of the building and the front of the window. Alternatively, a drain 162 can be placed on the lowermost portion of the space between the flood panel 156 and the window 25. This drain 162 will remove most of the water which gets around the flood panels 156 before the water can get to the window 25.

The following are test results of the present invention demonstrating its ability to meet and exceed the strict Miami-Dade County Building Codes for hydrostatic strength, system leakage and dynamic impact load placed on a window.

1.0 Manufacturer's Identification 1.1 Name of Applicant:

Savannah Trims, Inc.

3567 91st Street North, Ste #4

Lake Park, Fla. 33403

2.0 Laboratory Identification 2.1 HTL Test Notification: HTL09063

2.2 HTL Lab Certifications: Miami-Dade County (05-1014.01); Florida Building Code (TST1527); IAS (TL-244); AAMA; WDMA; Keystone Certificate; Texas Department of Insurance 3.0 Scope of Work 3.1 Introduction Hurricane Test Laboratory, LLC (HTL) was retained to conduct testing on a Flood Resistant Glazing System currently being distributed by Savannah Trims as a flood abatement system. As part of HTL's scope of work a thorough review was conducted of all applicable test standards for this Flood Resistant Glazing System for both Hurricane Mitigation and for Flood Mitigation.

HTL researched all standards for Flood Mitigation and determined that there are currently no standards that cover Flood Resistant Glazing System. Due to the lack of applicable standards, HTL and Savannah Trims developed a custom test method to test Flood Resistant Glazing System which includes applicable sections of the Florida Building Code HVHZ test protocols TAS 201 & TAS 203 (Hurricane Mitigation) as well as FM Approvals® Class Number 2510 (Flood Mitigation). The following outlines the test method HTL used to determine the performance of the Flood Resistant Grazing System when undergoing quasi-static riverine flooding conditions (i.e. slow rising and receding flood waters with minimal wave exposure) of depths not greater than 3 ft (0.9 m) and then subsequently undergoing conditions representative of windborne debris and the cyclic pressures encountered in a windstorm environment.

3.2 Summary of Test Method

This test method consists of loading the exterior (wet-side) of the Flood Resistant Glazing System with the medium used during flood conditions to varying test pressures for varying lengths of time. Deflection, deformations, leakage, and failures of any nature are observed.

The Flood Resistant Glazing System then undergoes a series of dynamic impact tests followed by hydrostatic loading to evaluate the structural response of the system to simulated debris impact and riverine flooding conditions.

Finally, the Flood Resistant Glazing System is impacted with a missile and subjected to cyclic pressures differences in accordance with a specified loading program to simulate the conditions encountered in a windstorm event, such as a hurricane.

3.3 Procedure 3.3.1 Hydrostatic Test Strength (FM Approvals® 2510)

The Flood Resistant Glazing System shall be subjected to a test pressure of 150 percent of the maximum system operating pressure for five minutes. The test medium shall be the medium used during operation. No rupture, cracking, or permanent distortion of the specimen is allowed.

3.3.2 System Leakage Test (FM Approvals® 2510)

The upstream side of the Flood Resistant Glazing System shall be subjected to a test pressure of 120 percent of the maximum system operating pressure to prove sealing ability. The test medium shall be the medium used during operation. The test pressure shall be held for five minutes with no leakage allowed.

3.3.3 Hydrostatic Load Test (FM Approvals® 2510)

The Hydrostatic Load Test evaluates the structural and hydraulic response of the Flood Resistant Glazing System to quasi-static, hydraulic loading. The exterior (wet-side) of the Flood Resistant Glazing System shall be flooded to 100 percent×h±0.25 in, where h is the vendor specified design water depth for the structure or 3.0 ft, whichever is lower. The water level shall be held at constant height for a minimum of 22 hours. The recorded rate of leakage shall not exceed 0.08 gallons per hour per linear foot of opening over any 15-minute period. Rate of leakage refers to both leakage through the Flood Resistant Glazing System and seepage around the Flood Resistant Glazing System (perimeter leakage). Exceeding the maximum rate of leakage shall result in a failure.

3.3.4 Dynamic Impact Load Test (FM Approvals® 2510)

The dynamic impact load test evaluates the structural response of a Flood Resistant Glazing System to a simulated debris impact. Immediately following each impact, a hydrostatic load test shall be conducted with a water level equal to 100 percent×h±0.25 in. Leakage rate measurements shall adhere to the hydrostatic load test above.

4.0 Product Identification 4.1 Product Type: Curtain Wall 4.2 Model Designation: Flood Resistant Glazing System 4.3 Performance Class: +/−80 psf Design Pressure and 38⅙" Design Water Depth 4.4 Overall Size: 61" (w)×85" (h)

4.5 Configuration: Fixed 4.6 Drawings: This test report is incomplete if not accompanied by Savannah Trims, Inc. drawing labeled "Flood Resistant Glazing System" (Sheets 1 through 4) bearing the ink stamp of Hurricane Test Laboratory, LLC.

4.7 Sample Source: Savannah Trims, Inc.

5.0 Product Description & Installation 5.1 Frame Construction

Please reference the attached drawings and Miami-Dade NOA #07-0625.12 for a full description of the system tested with the exceptions described below:

5.1.1 Typical Frame Corner Construction

At each corner, the vertical member ran through while the horizontal member was square cut and butted to the vertical member. The vertical member was then mechanically attached to the horizontal member using two (2), #12×1¼" slotted hex washer head SMS.

5.1.2 Sealants Used

Table 5.2 provides summary of the sealants used in each test specimen.

TABLE 5.2

Sealant Details

| Location | Sealant Description |
|---|---|
| Perimeter Sealant | "Great Stuff" & Dow Corning ® 995 Silicone Structural Glazing Sealant as noted on Sheets 2 & 3 of the attached drawings. |

6.0 Test Sequence

Table 6.1 provides a summary of the test sequence for each test specimen tested.

TABLE 6.1

Test Sequence

| Specimen # | Test | Standard/s | Condition | Duration | Notes |
|---|---|---|---|---|---|
| 1 | Hydrostatic Test Strength | FM 2510: Component & Materials Testing | 150 percent × h ± 0.25 in (0.6 cm) | 5 minutes | No rupture, cracking, or permanent distortion |
| 1 | System Leakage | | 120 percent × h ± 0.25 in (0.6 cm) | 5 minutes | No leakage allowed |
| 1 | Hydrostatic Load | FM 2510: Opening Barriers | 100 percent × h ± 0.25 in (0.6 cm) | 22 hours | Tests conducted sequentially with the same sample |
| | Dynamic Impact Load | | 1) 600 J impact at weak point on panel 2) Hydrostatic load test at 100 percent × h ± 0.25 in (0.6 cm) | 1 hour | Hydrostatic load test conducted 3 times Impact test conducted once per location |

TABLE 6.1-continued

| Test Sequence | | | | | |
|---|---|---|---|---|---|
| Specimen # | Test | Standard/s | Condition | Duration | Notes |
| | | | 1) 600 J impact at weak point of frame 2) Hydrostatic load test at 100 percent × h ± 0.25 in (0.6 cm) | 1 hour | No major repairs allowed Leakage rate shall not exceed 0.08 gal/hr/ft during Hydrostatic Load Test |
| | | | Additional locations on panel or frame | N/A | |
| 1 | Large Missile Load | TAS 201 & ASTM E1886/E1996 Level D | 9-lb wood 2 × 4 at 50 ft/sec | N/A | No signs of penetration, rupture, or opening after the large missile impact test |
| 1 | Cyclic Load | TAS 203 & ASTM E1886/E1996 | — | 9000 Cycles | No signs of failure |
| 2 | Dynamic Impact Load | FM 2510: Opening Barriers | 1) 600 J impact at weak point on panel | 1 hour | Tests conducted sequentially with the same sample |
| | | | 2) Hydrostatic load test at 100 percent × h ± 0.25 in (0.6 cm) | | Hydrostatic load test conducted 2 times |
| | | | 1) 600 J impact at weak point of frame | 1 hour | Impact test conducted once per location |
| | | | 2) Hydrostatic load test at 100 percent × h ± 0.25 in (0.6 cm) | | No major repairs allowed Leakage rate shall not exceed 0.08 gal/hr/ft during Hydrostatic Load Test |
| | | | Additional locations on panel or frame | N/A | |

7.0 Conclusion 7.1.3 Conclusion—Hydrostatic Test Strength

HTL observed no rupture, cracking, or permanent distortion of the test specimen; as such, this test specimen satisfies the requirements of FM 2510: Component & Materials Testing.

7.2 System Leakage Test 7.2.1 Results—System Leakage Test

Table 7.2 provides the results for the System Leakage test conducted per the requirements of FM 2510: Component & Materials Testing.

TABLE 7.2

| System Leakage Test Results | | | |
|---|---|---|---|
| Specimen # | Water Height (in.) | Test Duration (minutes) | Conclusion |
| 1 | 45.8 | 5 | No Leakage |

7.2.2 Conclusion—Water Infiltration Test

HTL observed zero (0) water leakage through the test specimen; as such, this test specimen satisfies the requirements of FM 2510: Component & Materials Testing.

7.3 Hydrostatic Load Test 7.3.1 Results—Hydrostatic Load

Table 73 provides the Hydrostatic Load test results.

TABLE 7.3

| Hydrostatic Load Test Results | | |
|---|---|---|
| Time (Hours) | Leakage (gal/hr/ft) | Conclusion |
| 0.25 | 0.00 | PASS |
| 0.50 | 0.00 | PASS |
| 0.75 | 0.00 | PASS |
| 1.00 | 0.00 | PASS |

TABLE 7.3-continued

| Hydrostatic Load Test Results | | |
|---|---|---|
| Time (Hours) | Leakage (gal/hr/ft) | Conclusion |
| 1.25 | 0.00 | PASS |
| 1.50 | 0.00 | PASS |
| 1.75 | 0.00 | PASS |
| 2.00 | 0.00 | PASS |
| 2.25 | 0.00 | PASS |
| 2.50 | 0.00 | PASS |
| 2.75 | 0.00 | PASS |
| 3.00 | 0.00 | PASS |
| 3.25 | 0.00 | PASS |
| 3.50 | 0.00 | PASS |
| 3.75 | 0.00 | PASS |
| 4.00 | 0.00 | PASS |
| 4.25 | 0.00 | PASS |
| 4.50 | 0.00 | PASS |
| 4.75 | 0.00 | PASS |
| 5.00 | 0.00 | PASS |
| 15.50 | 0.00 | PASS |
| 15.75 | 0.00 | PASS |
| 16.00 | 0.00 | PASS |
| 16.25 | 0.00 | PASS |
| 16.50 | 0.00 | PASS |
| 16.75 | 0.00 | PASS |
| 17.00 | 0.00 | PASS |
| 17.25 | 0.00 | PASS |
| 17.50 | 0.00 | PASS |
| 17.75 | 0.00 | PASS |
| 18.00 | 0.00 | PASS |
| 18.25 | 0.00 | PASS |
| 18.50 | 0.00 | PASS |
| 18.75 | 0.00 | PASS |
| 19.00 | 0.00 | PASS |
| 19.25 | 0.00 | PASS |
| 19.50 | 0.00 | PASS |
| 19.75 | 0.00 | PASS |
| 20.00 | 0.00 | PASS |
| 20.25 | 0.00 | PASS |
| 20.50 | 0.00 | PASS |
| 20.75 | 0.00 | PASS |

TABLE 7.3-continued

| Hydrostatic Load Test Results | | |
|---|---|---|
| Time (Hours) | Leakage (gal/hr/ft) | Conclusion |
| 21.00 | 0.00 | PASS |
| 21.25 | 0.00 | PASS |
| 21.50 | 0.00 | PASS |
| 21.75 | 0.00 | PASS |
| 22.00 | 0.00 | PASS |

7.3.1.1 Conclusion—Hydrostatic Load Test

HTL observed no signs of failure in any area of this test specimen during the hydrostatic load test. In addition, each specimen met the leakage rate requirements; as such, this test specimen satisfies the Hydrostatic Load test requirements of FM 2510: Opening Barriers.

TABLE 7.4

| Dynamic Impact Load Test Results | | | | | | |
|---|---|---|---|---|---|---|
| Specimen # | Impact # | Temp. (° F.) | Instant Deflection (in.) | Permanent Deflection (in.) | X Coord.[1] (in.) | Y Coord.[2] (in.) |
| 1 | 1 | 87.3 | 1.38 | 0.88 | 27.00 | 23.00 |
| | 2 | 87.7 | — | — | 50.00 | 27.00 |

[1]Measured from the left side of test specimen.
[2]Measured from the bottom of test specimen.

7.4.3 Results—Hydrostatic Load

Table 7.5 provides the Hydrostatic Load test results.

TABLE 7.5

| Hydrostatic Load Test Results | | | | |
|---|---|---|---|---|
| specimen # | Test # | Time (Hours) | Leakage (gal/hr/ft) | Conclusion |
| 1 | 1 | 0.25 | 0.00 | PASS |
| | | 0.50 | 0.00 | PASS |
| | | 0.75 | 0.00 | PASS |
| | | 1.00 | 0.00 | PASS |
| | 2 | 0.25 | 1.08 | FAIL* |
| | | 0.50 | 1.75 | FAIL* |
| | | 0.75 | 1.81 | FAIL* |
| | | 1.00 | 2.35 | FAIL* |

*Please see Section 7.7 for the passing results of the qualification testing of Specimen #2

7.4.4 Conclusion—Dynamic Impact Load

During the second post-impact hydrostatic load test, leakage exceeded 0.08 gallons per hour per linear foot of opening over a 15-minute period and therefore was considered a failure. Upon investigation of the first specimen, after the 2nd post-impact hydrostatic load test, Savannah Trims determined that the failure of the unit was due to the perimeter impact being adjacent to the 1¼" mullion. Savannah Trims decided that in all applications of their Flood Resistant Glazing System, Savannah Trims would only use a 2½" mullion.

HTL decided to move forward with hurricane mitigation impact and cyclic testing per TAS 201 and TAS 203 to determine whether post-dynamic impact the Flood Resistant Gluing System could withstand the forces encountered in a windstorm event, such as a hurricane.

7.5 Large Missile Impact Test 7.5.1 Large Missile Impact Locations

FIG. 7.3 shows the large missile impact location for the specimen tested.

7.6.3 Deflection Results—Cyclic Load Test

Table 7.9 shows the cyclic test results for each test specimen.

TABLE 7.9

| Cyclic Load Test Results | | | |
|---|---|---|---|
| Spec # | Gage Loc. | Inward (Positive Load) Permanent Set (in.) | Outward (Negative Load) Permanent Set (in.) |
| 1 | A | 0.031 | 0.250 |
| | B | 0.000 | 0.250 |
| | C | 0.000 | 0.125 |
| | D | 0.000 | 0.125 |
| | E | 0.000 | 2.750 |

7.6.4 Conclusion—Cyclic Load Test

Upon completion of the cyclic load test, HTL carefully inspected the test specimens for failures. HTL observed no signs of failure; as such, this test specimen satisfies the cyclic load test requirements of TAS 203 and ASTM E1886/1996.

7.7 Dynamic Impact Load Test 7.7.1 Dynamic Impact Load Locations

FIG. 7.6 shows the Dynamic Impact Load locations for the specimen tested.

Please Note: Since the first Savannah Trims specimen passed the hydrostatic test strength, system leakage test, 22-hour hydrostatic load test and hurricane mitigation tests (TAS 201 & TAS 203) without any failures, HTL determined that it was only necessary to perform the two dynamic impact load and post-impact hydrostatic load tests on Specimen #2.

TABLE 7.10

| Dynamic Impact Load Test Results | | | | | | |
|---|---|---|---|---|---|---|
| Specimen # | Impact # | Temp. (° F.) | Instant Deflection (in.) | Permanent Deflection (in.) | X Coord.[1] (in.) | Y Coord.[2] (in.) |
| 2 | 1 | 83.2 | 2.00 | 1.38* | 32.00 | 23.00 |
| | 2 | 84.7 | 0.75 | 0.56 | 7.00 | 29.50 |

[1]Measured from the left side of test specimen.
[2]Measured from the bottom of test specimen.
*Please note:
FM Standard 2510 Section 4.3 Opening Barriers Subsection B. Permanent Deflection states that the maximum amount of permanent deflection allowed after the Dynamic Load Impact test outlined in Section 4.3.3 shall be less than a quantity of L/120 but not greater than 1 inch, where L is the linear span of the opening measured in inches. Permanent dents at the point of impact shall be allowed as long as they do not impair the functionality of the barrier as determined by FM Approvals. This specimen's permanent deflection was greater than the allowable, however, it passed the subsequent Hydrostatic Load tests showing this dent did not impair functionality and therefore did not fail per above mentioned standard.

7.7.3 Results—Hydrostatic Load

Table 7.11 provides the Hydrostatic Load test results.

TABLE 7.11

| Hydrostatic Load Test Results | | | | |
|---|---|---|---|---|
| Specimen # | Test # | Time (Hours) | Leakage (gal/hr/ft) | Conclusion |
| 2 | 1 | 0.25 | 0.00 | PASS |
| | | 0.50 | 0.00 | PASS |
| | | 0.75 | 0.00 | PASS |
| | | 1.00 | 0.00 | PASS |

TABLE 7.11-continued

| Hydrostatic Load Test Results | | | | |
|---|---|---|---|---|
| Specimen # | Test # | Time (Hours) | Leakage (gal/hr/ft) | Conclusion |
| | 2 | 0.25 | 0.00 | PASS |
| | | 0.50 | 0.00 | PASS |
| | | 0.75 | 0.00 | PASS |
| | | 1.00 | 0.00 | PASS |

7.7.4 Conclusion—Dynamic Impact Load

HTL observed no signs of failure in any area of this test specimen during the impact load tests and hydrostatic load tests. In addition, each specimen met the leakage rate requirements; as such, this test specimen satisfies the Dynamic Impact Load test requirements of FM 2510: Opening Barriers.

8.0 Summary 8.1.1 Summary of Test Results

Table 8.1 provides a summary of the test results for Savannah Trims Inc.'s Flood Resistant Glazing System.

TABLE 8.1

| Summary of Test Results | | | |
|---|---|---|---|
| Specimen # | Test Method | Test Conditions | Test Conclusion |
| 1 | Hydrostatic Test Strength (FM 2510: Component & Materials Testing) | 150 percent × h ± 0.25 in (06 cm) | PASS |
| 1 | System Leakage Test (FM 2510: Component & Materials Testing) | 120 percent × h ± 0.25 in (0.6 cm) | PASS |
| 1 | Hydrostatic Load Test (FM 2510: Opening Barriers) | 100 percent × h ± 0.25 in (0.6 cm) | PASS |
| 1 | Dynamic Impact Load Test (FM 2510: Opening Barriers) | 1) 600 J impact at weak point on panel | PASS |
| | | 2) Hydrostatic load test at 100 percent × h ± 025 in (0.6 cm) | PASS |
| | | 1) 600 J impact at weak point of frame | PASS |
| | | 2) Hydrostatic load test at 100 percent × h ± 0.25 in (0.6 cm) | FAIL* |
| 1 | Large Missile Impact Test (TAS 201 and ASTM E1886/E1996) | — | PASS |
| 1 | Cyclic Load Test (TAS 203 and ASTM E1886/E1996) | +/−80 psf Design Pressure | PASS |
| 2 | Dynamic Impact Load Test (FM 2510: Opening Barriers) | 1) 600 J impact at weak point on panel | PASS |
| | | 2) Hydrostatic load test at 100 percent × h ± 0.25 in (0.6 cm) | PASS |
| | | 1) 600 J impact at weak point of frame | PASS |
| | | 2) Hydrostatic load test at 100 percent × h ± 0.25 in (0.6 cm) | PASS |

*See Specimen #2 for requalification.

The following is a letter of acceptance by the Building Code Compliance Division of Miami-Dade County of the present invention for use in buildings. This letter indicates that the present invention meets and exceeds the strict Miami-Dade County hurricane standards for prevention of water into buildings through windows during extreme weather conditions, such as hurricanes.

Notice of Acceptance (NOA)

Alumiglass, Inc.

901 NW 35$^{th}$ Street, Suite 100

Boca Raton, Fla. 33431

SCOPE: This NOA is being issued under the applicable rules and regulations governing the use of construction materials. The documentation submitted has been reviewed by Miami-Dade County Product Control Division and accepted by the Board of Rules and Appeals (BORA) to be used in Miami Dade County and other areas where allowed by the Authority Having Jurisdiction (AHJ).

This NOA shall not be valid after the expiration date stated below. The Miami-Dade County Product Control Division (In Miami Dade County) and/or the AHJ (in areas other than Miami Dade County) reserve the right to have this product or material tested for quality assurance purposes. If this product or material fails to perform in the accepted manner, the manufacturer will incur the expense of such testing and the AHJ may immediately revoke, modify, or suspend the use of such product or material within their jurisdiction. BORA reserves the right to revoke this acceptance, if it is determined by Miami-Dade County Product Control Division that this product or material fails to meet the requirements of the applicable building code.

This product is approved as described herein, and has been designed to comply with the Florida Building Code, including High Velocity Hurricane Zone of the Florida Building Code.

DESCRIPTION: Aluminum Structural Glazed Curtain Wall System—LMI

APPROVAL DOCUMENT: Drawing No. 05-ALU-0059 titled "Alumiwall Impact System (LMI)", sheets 1 through 8 of 8, prepared by Engineering Express, signed and sealed by Frank L. Bennardo, P.E., bearing the Miami-Dade County Product Control Renewal stamp with the Notice of Acceptance number and expiration date by the Miami-Dade County Product Control Division.

MISSILE IMPACT RATING: Large and Small Missile Impact Resistant

LABELING: Each unit shall bear a permanent label with the manufacturer's name or logo, city, state and following statement: "Miami-Dade County Product Control Approved", unless otherwise noted herein.

RENEWAL of this NOA shall be considered after a renewal application has been filed and there has been no change in the applicable building code negatively affecting the performance of this product.

TERMINATION of this NOA will occur after the expiration date or if there has been a revision or change in the materials, use, and/or manufacture of the product or process. Misuse of this NOA as an endorsement of any product, for sales, advertising or any other purposes shall automatically terminate this NOA. Failure to comply with any section of this NOA shall be cause for termination and removal of NOA.

ADVERTISEMENT: The NOA number preceded by the words Miami-Dade County, Florida, and followed by the expiration date may be displayed in advertising literature. If any portion of the NOA is displayed, then it shall be done in its entirety.

INSPECTION: A copy of this entire NOA shall be provided to the user by the manufacturer or its distributors and shall be available for inspection at the job site at the request of the Building Official.

This NOA revises & renews #02-0308.03 and consists of this page land evidence sheet E1, as well as approval document mentioned above.

Notice of Acceptance: Evidence Submitted

A. Drawings (Transferred from File #02-0308.03)

1. Manufacturer's die drawings and sections.
2. Drawing No, 05-ALU-0059 titled "Alumiwall Impact System (LMI)", sheets 1 through 8 of 8, prepared by Engineering Express, signed and sealed by Frank L. Bernardo, P.E.

B. Tests (Test Reports Transferred from File #'02-0308.03) Original Test Report Conducted Per SFBC, PA 201, 202 & 203-94, Now Termed as FBC, TAS 201, 202 & 203-94.

Test report on

1) Air Infiltration Test, per PA 202-94
2) Uniform Static Air Pressure Test, Loading per PA 202-94
3) Water Resistance Test, per PA 202-94
4) Large Missile Impact Test, SFBC PA 201-94
5) Small Missile Impact Test, SFBC PA 201-94
6) Cyclic Loading Test, per SFBC PA 203-94 along with installation diagram of an aluminum curtain wall system prepared by Hurricane Test Laboratory, Inc.

C. Calculations

1. Anchor Calculations & structural analysis, prepared by Engineering Express, signed & sealed by Frank L. Bernardo, P. E.
2. Glazing complies w/ASTME-1300-02

Quality Assurance

1. Miami Dade Building Code Compliance Office (BCC %

E. Material Certifications

1. Notice of Acceptance No, 07-1116.04 issued to E.I. Dupont De Nemours for "Sentry alas Plus", expiring on Jan. 14, 2012.

Statements

1. Statement letter of conformance and "No financial interest", issued by Frank L. Bernardo, P.E. consulting Engineers, signed & sealed by Frank L. Bernardo, P.E.
2. Statement letter of compliance by the Hurricane Testing labs, part of above referenced test reports.

F. Other

1. This NOA revises & renews #02-0308.03.

Figure 15:
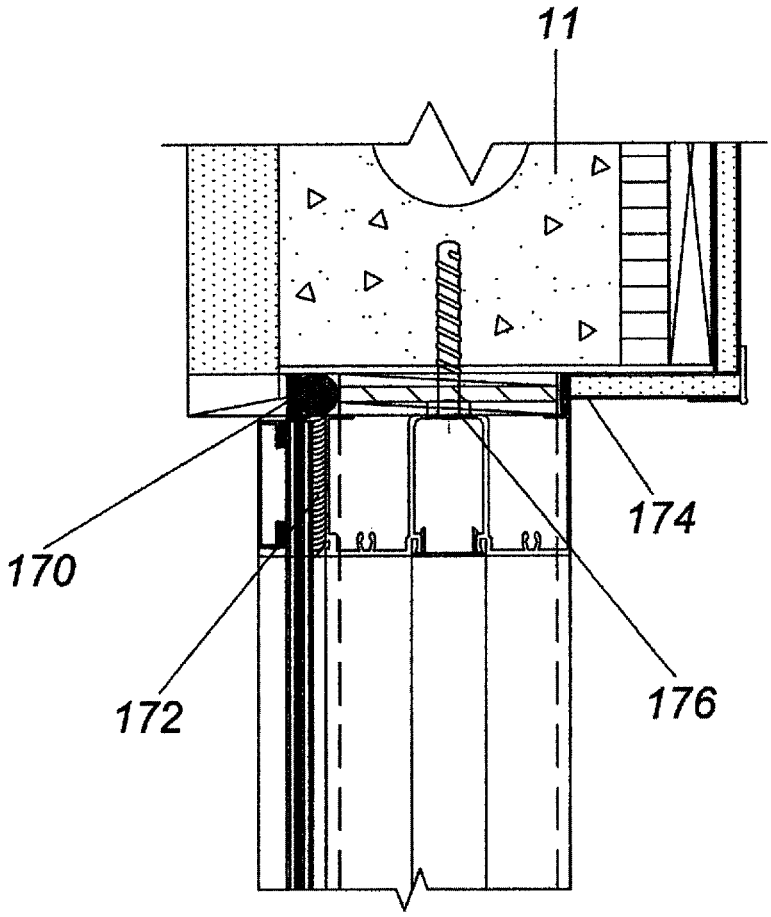
FIG. 15 is a head detail in FIG. 29.
Figure 29:
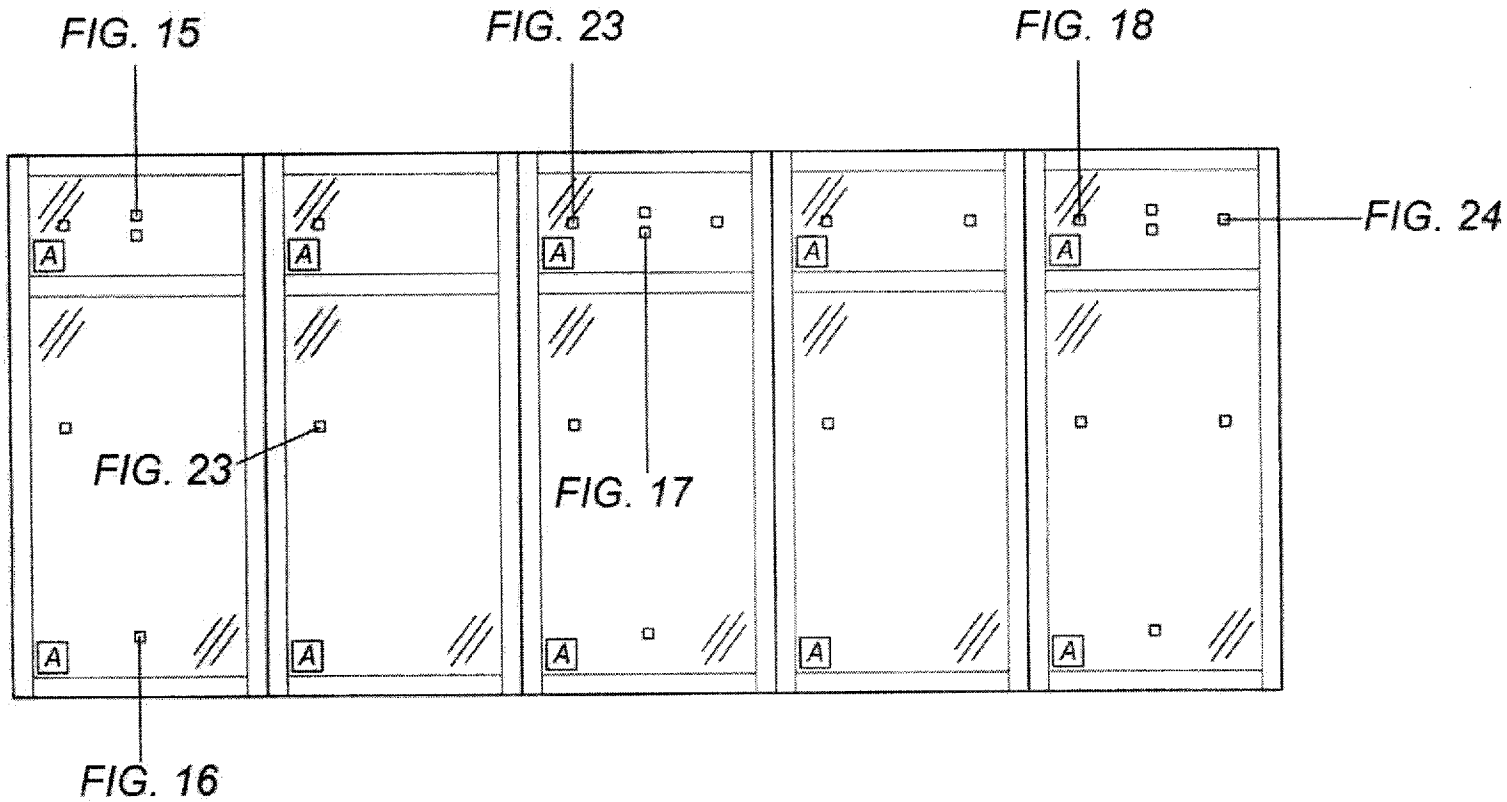
FIG. 29 is a curtain wall elevation of one embodiment of the present invention.

FIG. 15 illustrates the detail of the connection of a head of a window frame to a window opening 11 as shown in FIG. 29. A bead of sealant 170 is placed between a strip of continuous silicone sealant 172 and the window opening 11. An interior seal 174 is placed on the inside of the window frame to help seal against water and other elements. A wedge bolt 176 secures the head to the widow opening.

Figure 16:
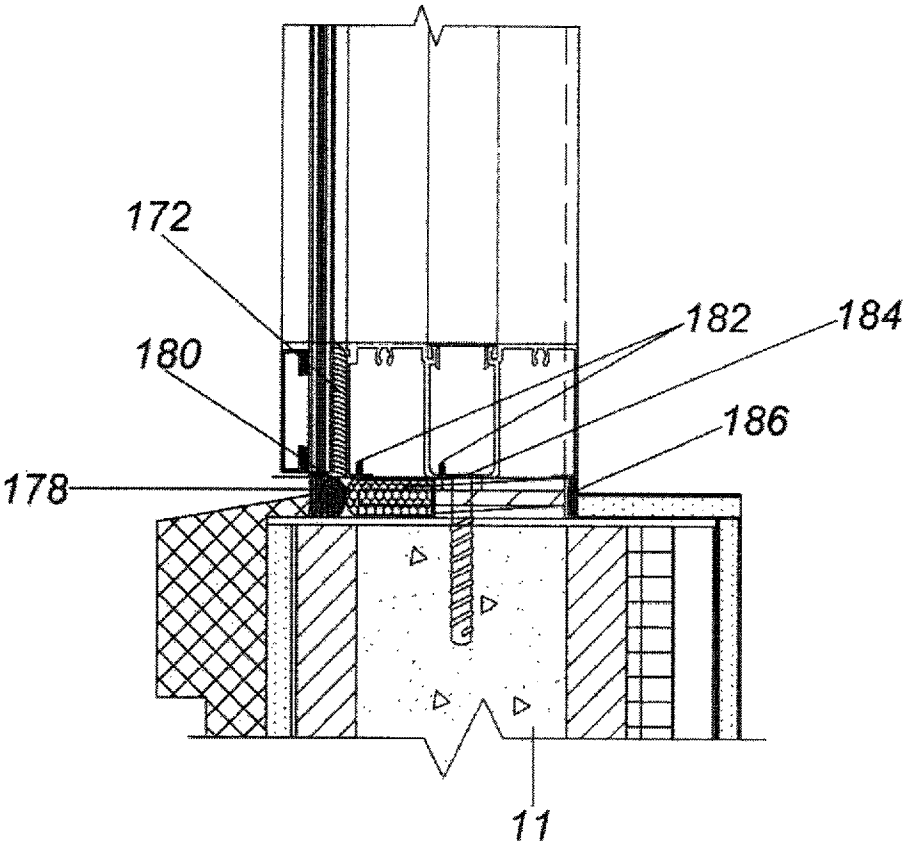
FIG. 16 is sill detail in FIG. 29.
Figure 17:
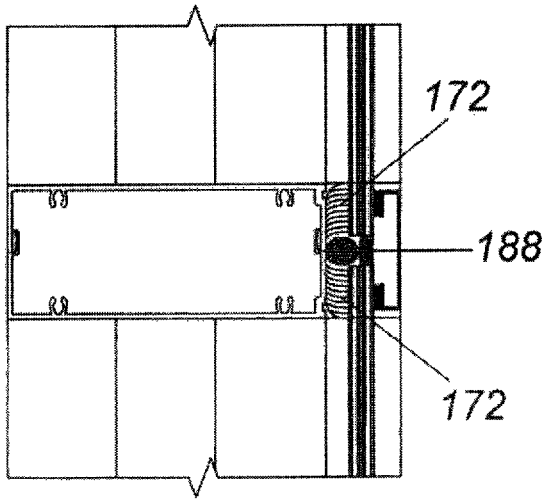
FIG. 17 is a horizontal detail in FIG. 29.

FIG. 16 is a detail of the connection of the sill of a window frame to a window opening 11. A sealant 178 is secured between the window frame and the window opening. This is similar to sealant 170 in FIG. 15. A continuous silicone sealant 172 is located above sealant 178. The flood protection element 180 of the present invention is similar to the flood protection elements of the prior embodiments. The element 180 includes a mechanical seal and an expansion element, which expands upon contact with water. Screws 182 secure the element 180 to the window frame. The presence of water forces the element 180 into a tight contact with the window frame. An anchor bolt 184 secured the window frame to the window opening and an interior sealant 186 helps to prevent water from entering the structure. FIG. 17 illustrates the relationship between a glass window and a herder window. A sealant and backer rod 188 is secured between two continuous silicone sealants 172.

Figure 18:
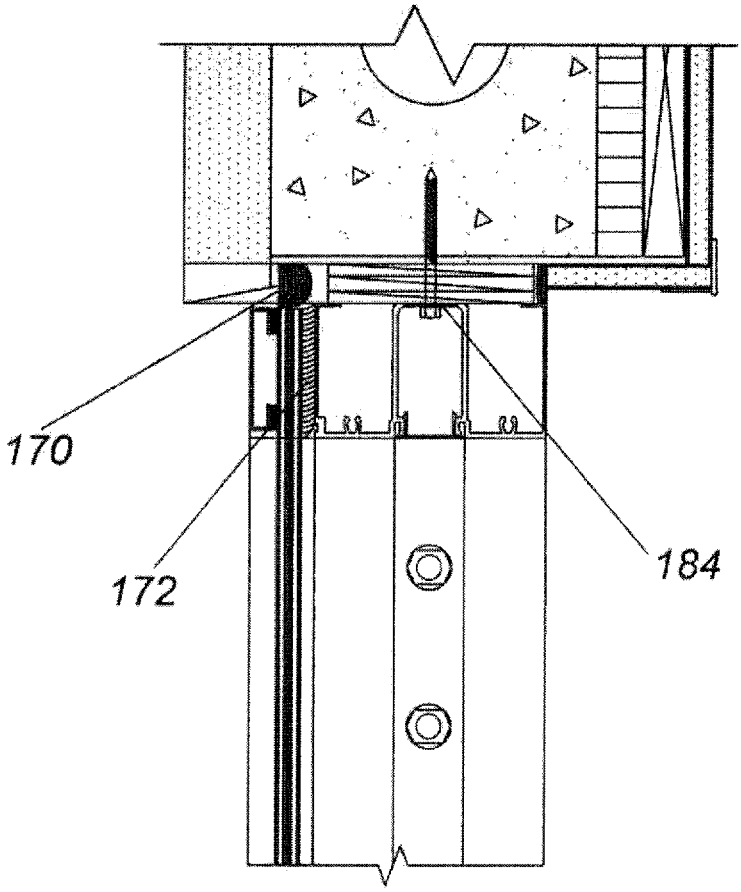
FIG. 18 is transom head detail in FIG. 29.
Figure 19:
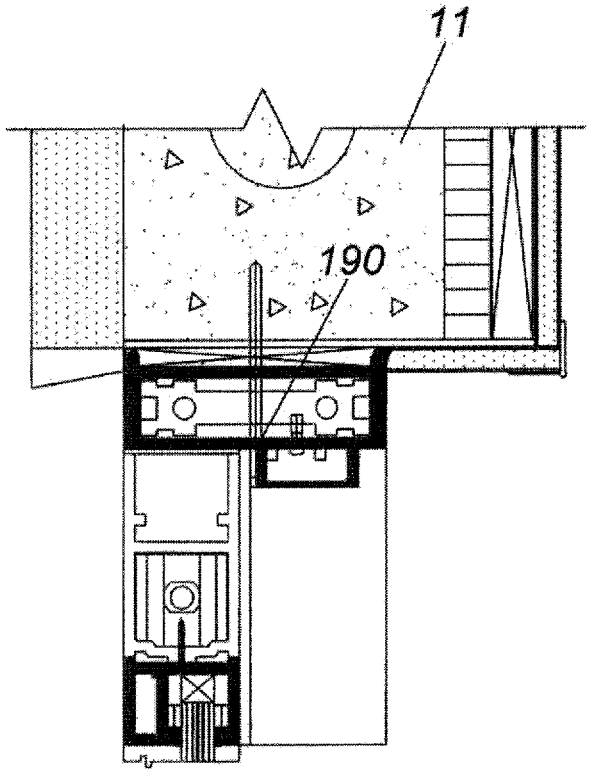
FIG. 19 is a header detail.

FIG. 18 illustrates a transom head detail as shown in FIG. 29. A continuous sealant 172 is located against the window glass and a sealant 178 is positioned between sealant 172 and a window opening 11. A bolt 184 secures the window frame to the window opening. An interior sealant 186 helps to prevent water from entering the structure. FIG. 19 is detail of a header. A masonry nail or similar fastener 190 secures the window frame to the window opening 11.

Figure 20:
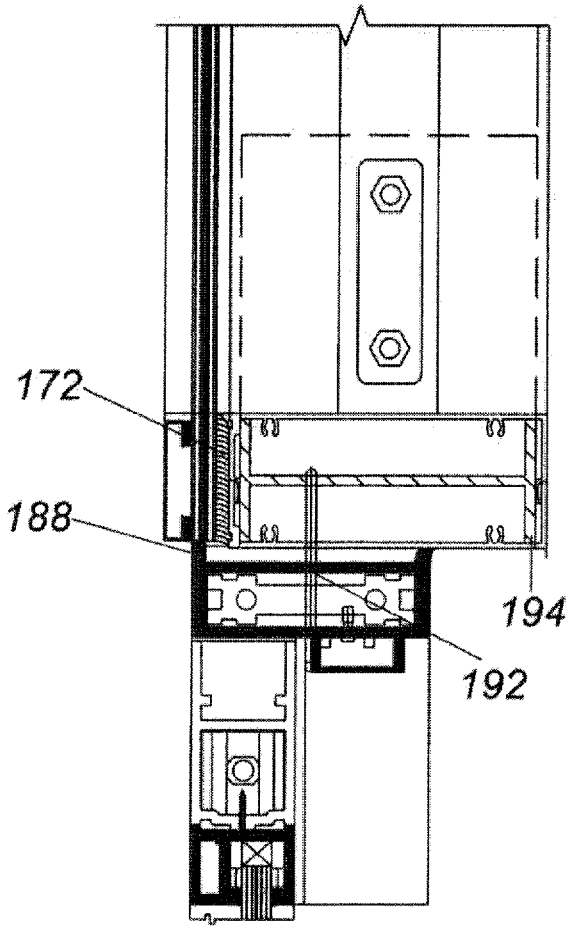
FIG. 20 is a transom/header detail in FIG. 30.
Figure 21:
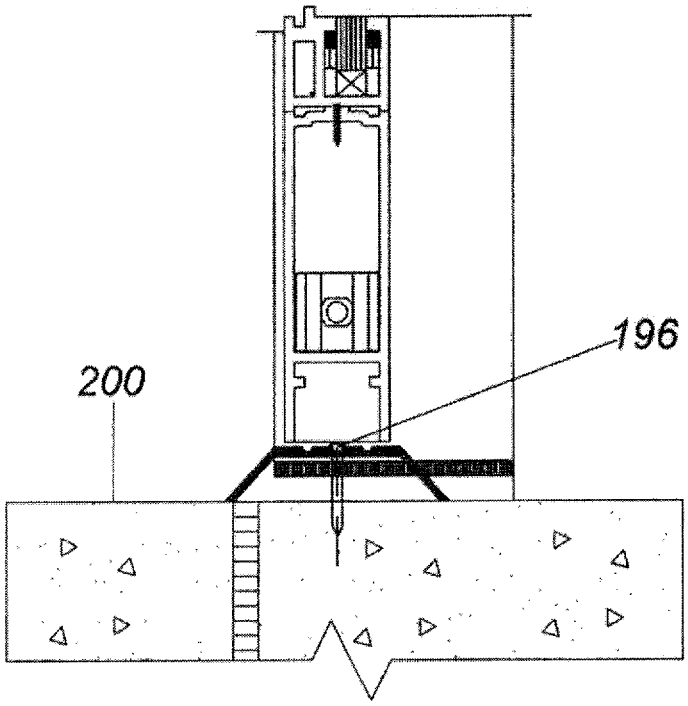
FIG. 21 is a bottom sill detail in FIG. 30.
Figure 22:
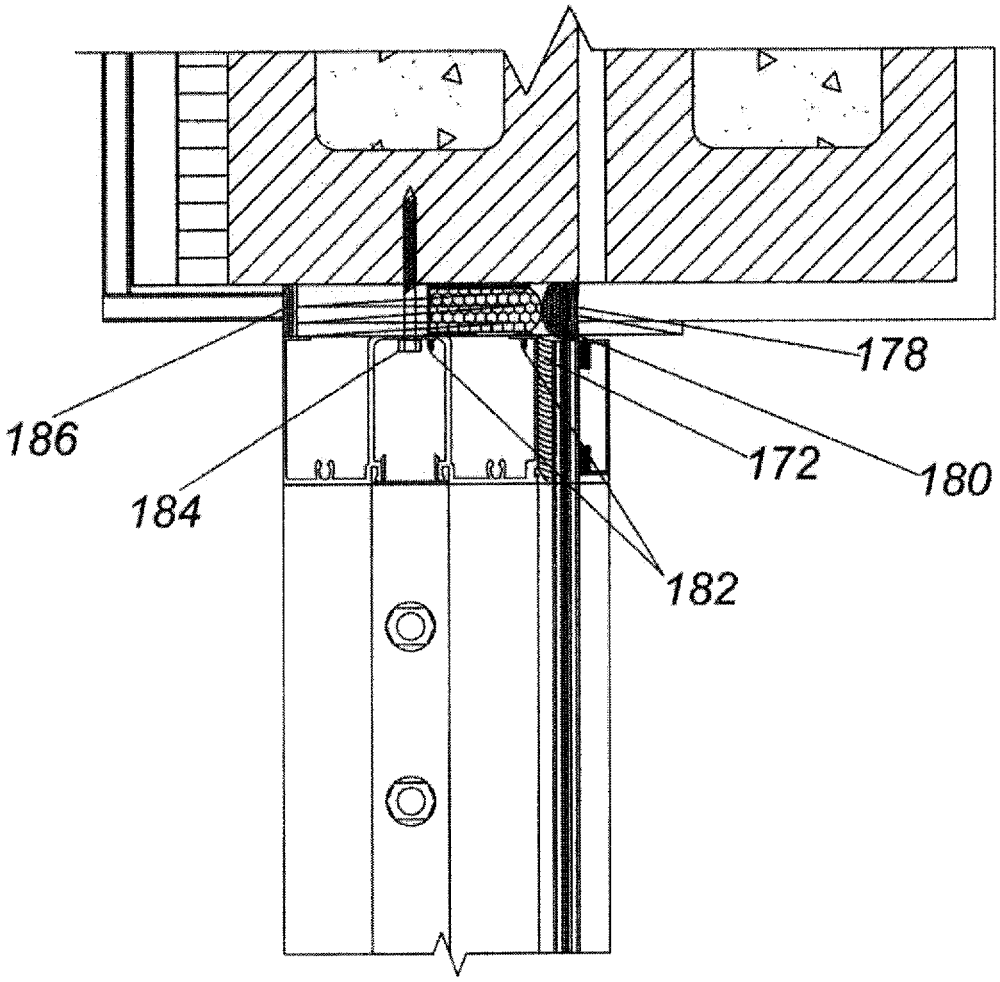
FIG. 22 is jamb detail in FIG. 30.
Figure 23:
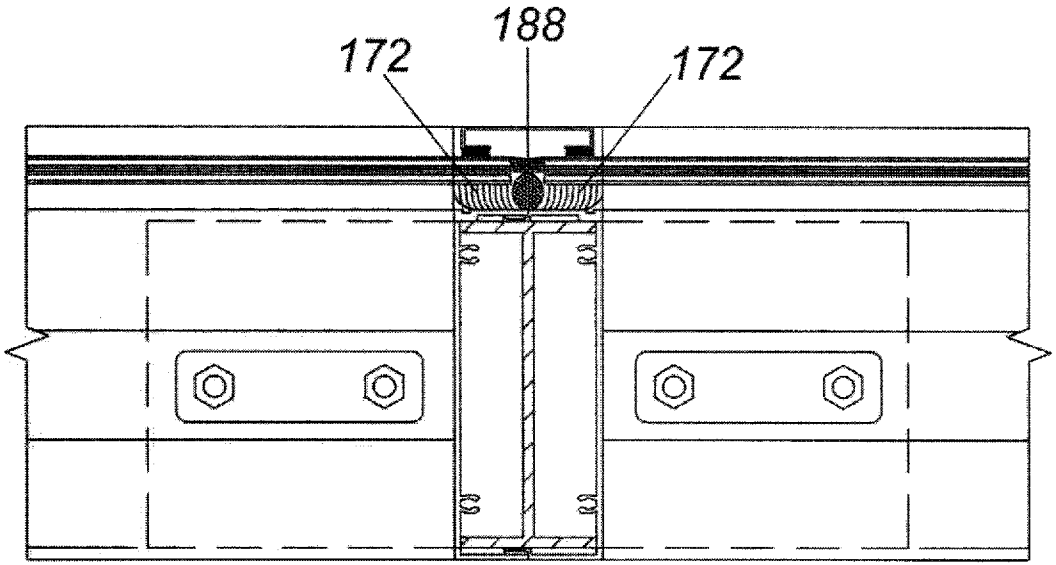
FIG. 23 is a vertical detail in FIG. 29.
Figure 30:
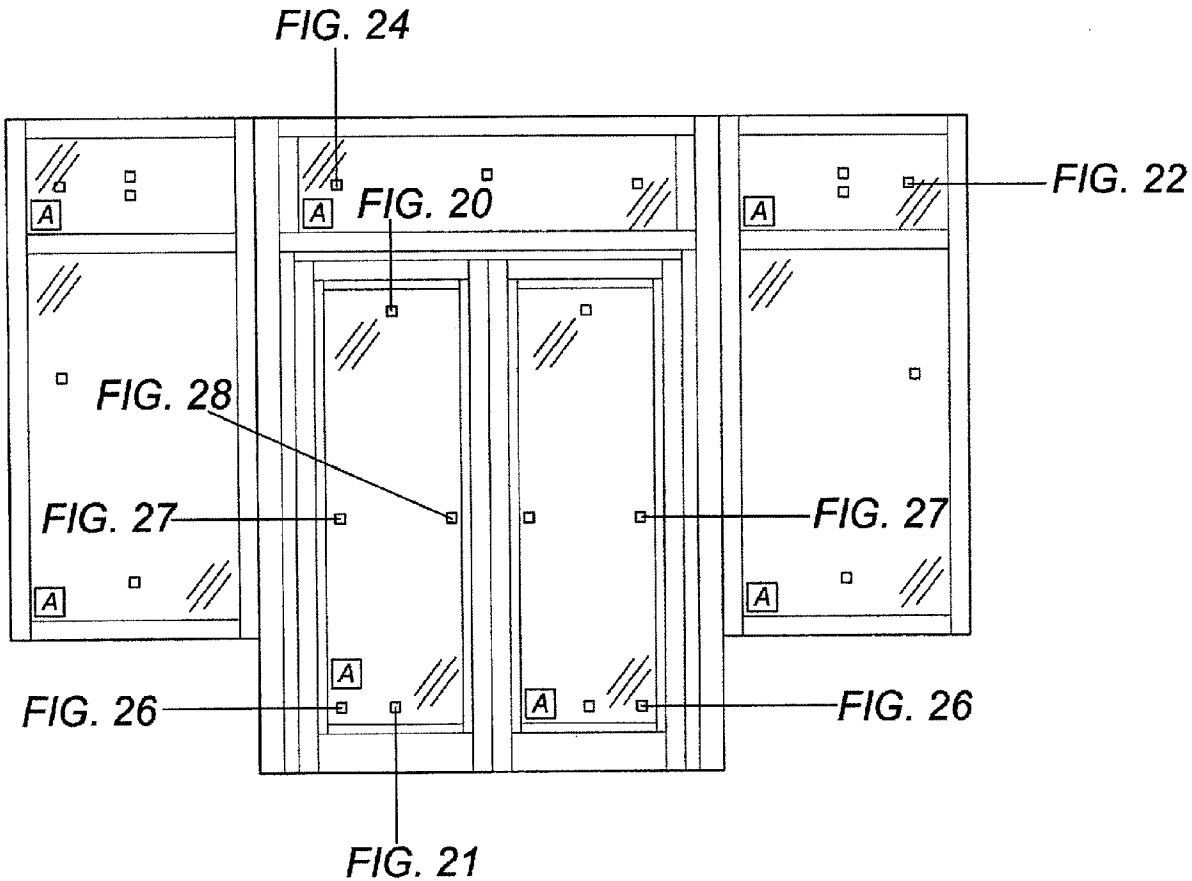
FIG. 30 is a curtain wall elevation of another embodiment of the present invention.

FIG. 20 illustrates a transom/header detail, as shown in FIG. 30. A continuous silicone sealant 172 is located against the window frame and also against the window glass. A backer rod 188 is located adjacent the sealant 172. A self tapping screw or similar fastener 192 secures the window frame to the door header 194. FIG. 21 illustrates a bottom sill detail as shown in FIG. 30. A door sill is secured to a door opening 200 by a fastener 198. FIG. 22 illustrates the detail of a jamb as shown in FIG. 30. A continuous silicone sealant 172 is located between the window glass and the window frame. A sealant 178 is located adjacent the exterior of the window frame and glass. The protection element 180 in located between the window frame and the window opening. A pair of screws 182 secure the element 180 to the window frame. An anchor bolt 184 secures the window frame to the window opening. Finally, an interior sealant 186 helps to prevent water from entering the structure. FIG. 23 illustrates a vertical detail as shown in FIG. 29. Two glass panes are abutted against each other. A continuous silicone sealant 172 is positioned between each glass pane and the window frame. Finally, a backer rod 188 is positioned between the two continuous silicone sealants 172.

Figure 24:
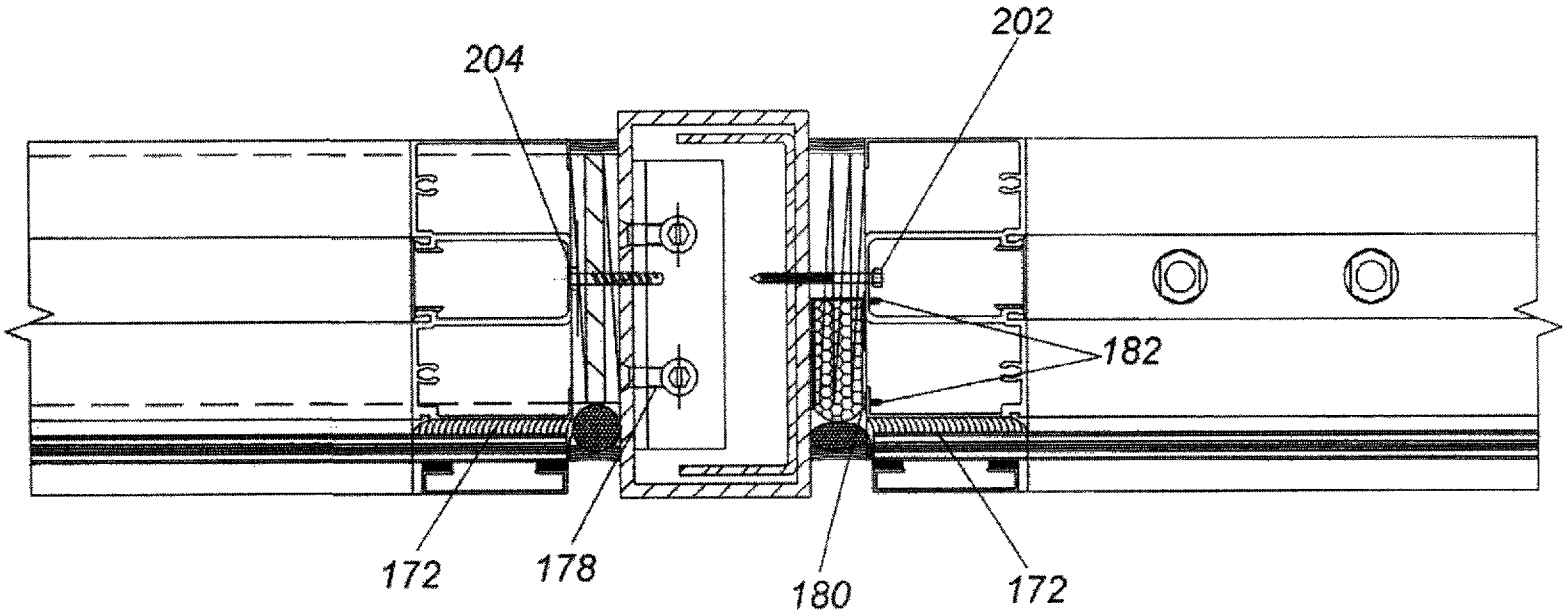
FIG. 24 is a jamb detail in FIG. 29.
Figure 25:
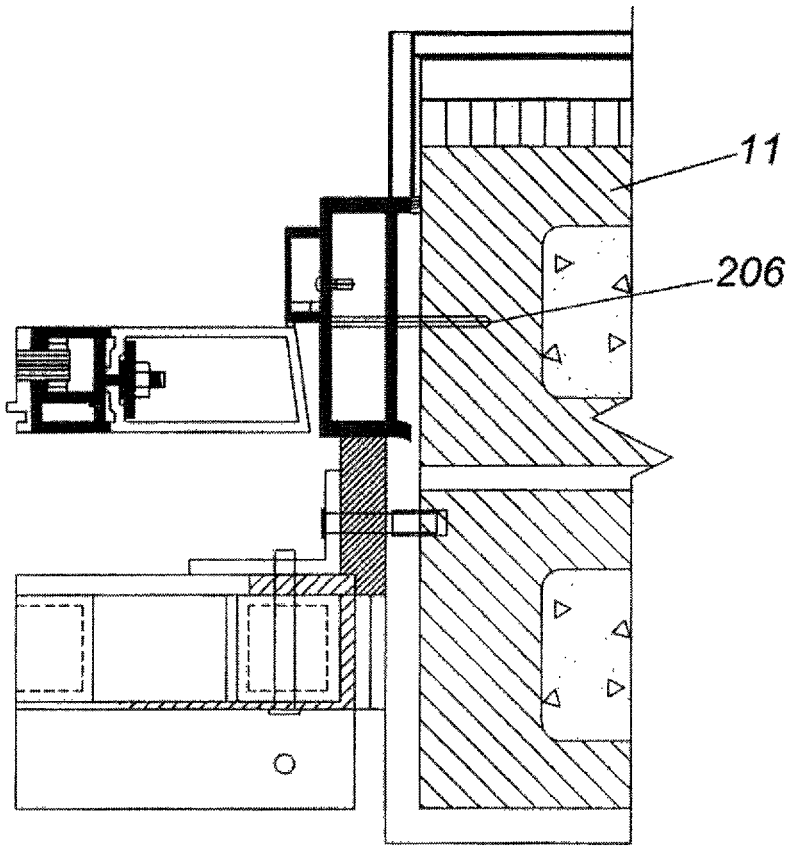
FIG. 25 is a door jamb detail.
Figure 26:
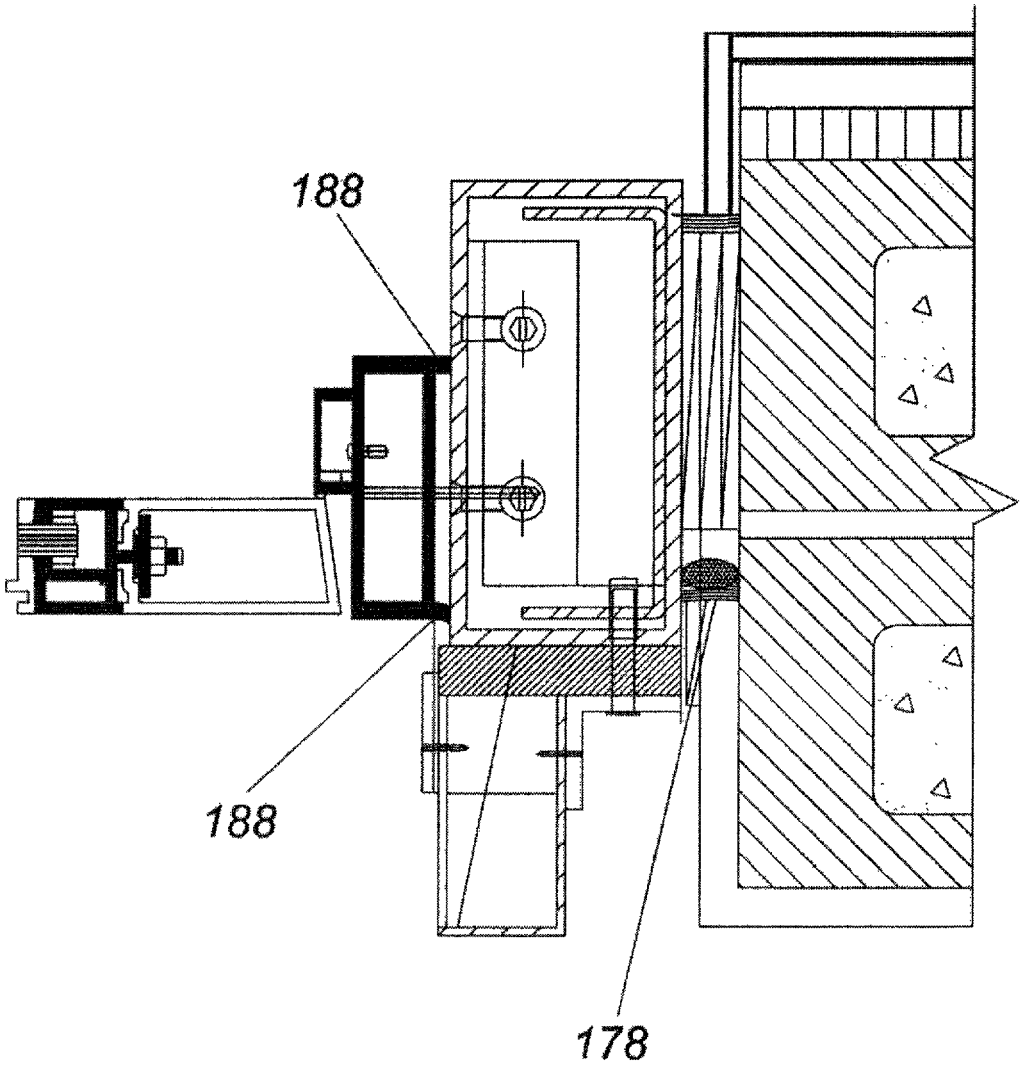
FIG. 26 is a jamb detail in FIG. 30.

FIG. 24 illustrates a jamb detail, as shown in FIG. 30. Window glass panes are secured adjacent the window frame. A continuous silicone sealant 172 is positioned between the glass panes and the window frame. A sealant 178 is positioned between the frame and the glass pane. The flood protection element 180 of the present invention is positioned between the elements of the window frame behind the sealant 178. Fasteners 202 and 204 secure the elements of the window frame. Screws 182 secure the flood protection element 180 to the window frame. FIG. 25 illustrates a door jamb detail. A frame is secured to the window opening 11 by a fastener 206. FIG. 26 illustrates a jamb detail as shown in FIG. 30. A frame is located adjacent the window opening 11. A sealant 178 is located between the frame and the opening 11. Backer rods 188 are positioned between elements of the frame.

Figure 27:
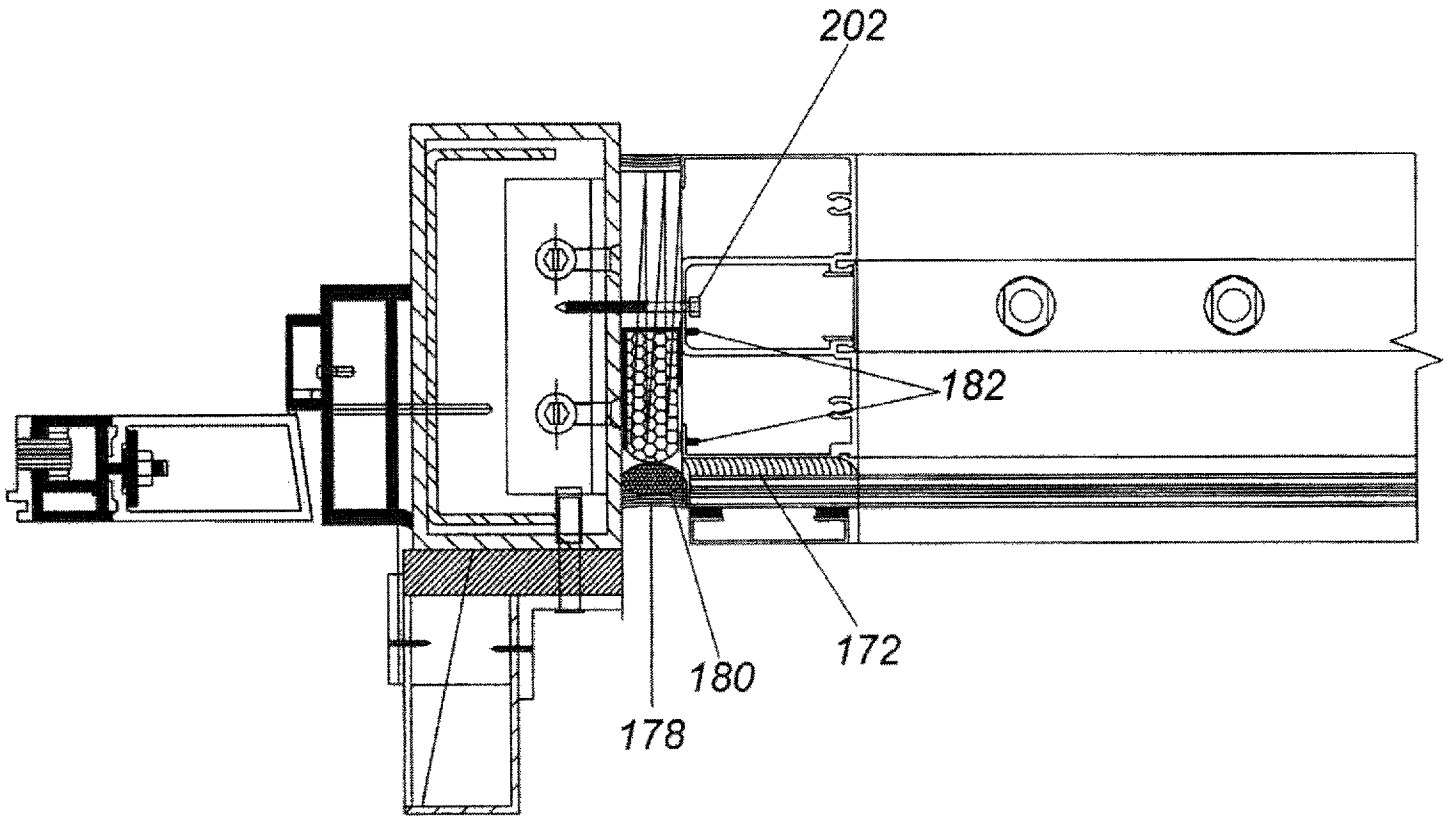
FIG. 27 is a jamb detail in FIG. 30.
Figure 28:
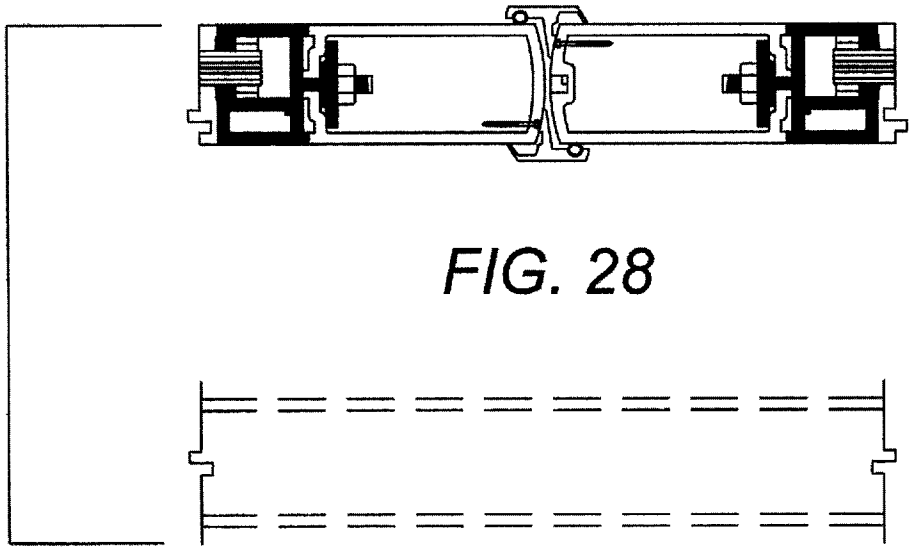
FIG. 28 is a door meeting detail in FIG. 30.

FIG. 27 illustrates a further jamb detail as shown in FIG. 30. A backer rod 188 is positioned between elements of the frame. A sealant 178 is positioned between the window glass and the frame, adjacent an outer surface. The flood protection element 180 is positioned behind the sealant 178. A continuous silicone sealant 172 is positioned between the glass and the frame. A pair or screws 182 secure the flood protection element of the present invention to the frame. FIG. 28 illustrated the detail between doors, as shown in FIG. 30. FIG. 29 is an elevation of a wall of glass panes including headers. FIG. 30 is an elevation of a glass wall including doors and headers.

Figure 31:
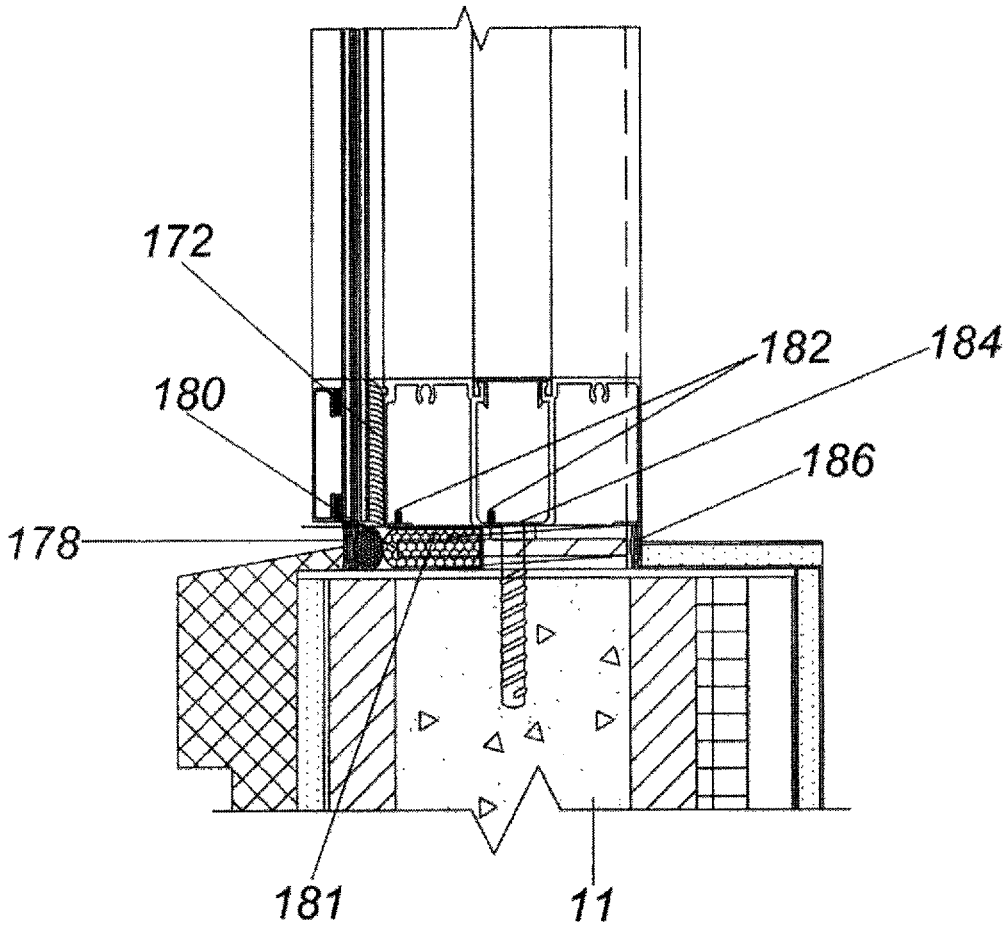
FIG. 31 is an another embodiment of the seal illustrated in FIG. 16.

FIG. 31 is a detail of the connection of the sill of a window frame to a window opening 11. FIG. 31 illustrates and another embodiment of the seal illustrated in FIG. 16. A sealant 178 is secured between the window frame and the window opening. This is similar to sealant 170 in FIG. 15. A continuous silicone sealant 172 is located above sealant 178. The flood protection element 180 of the present invention is similar to the flood protection elements of the prior embodiments. The element 180 includes a mechanical seal and an expansion element, which expands upon contact with water. The mechanical seal 181 is substantially "L" shaped. Screws 182 secure the element 181 to the window frame. The presence of water forces the element 181 into a tight contact with the window frame. An anchor bolt 184 secured the window frame to the window opening and an interior sealant 186 helps to prevent water from entering the structure.

Figure 32:
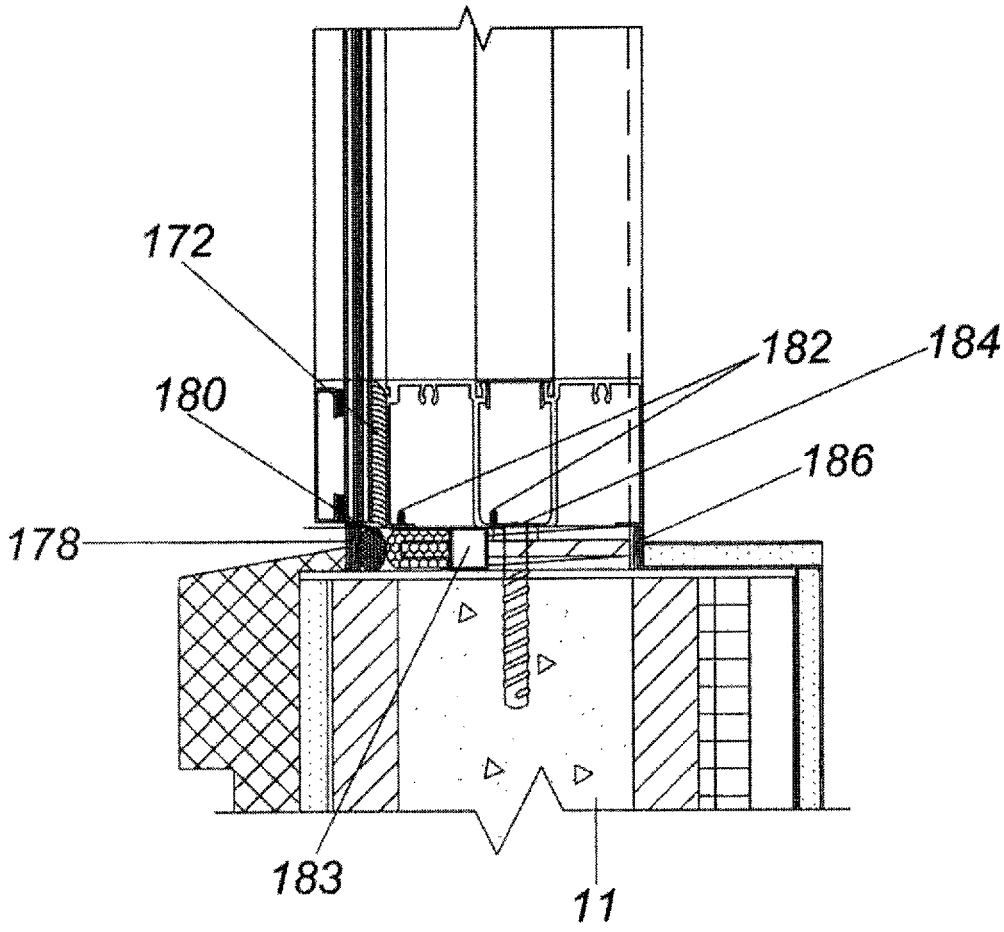
FIG. 32 is a further embodiment of the seal illustrated in FIG. 16.

FIG. 32 illustrates another embodiment of the seal illustrated in FIG. 16. A sealant 178 is secured between the window frame and the window opening. This is similar to sealant 170 in FIG. 15. A continuous silicone sealant 172 is located above sealant 178. The flood protection element 180 of the present invention is similar to the flood protection elements of the prior embodiments. The element 180 includes a mechanical seal 183 and an expansion element, which expands upon contact with water. The mechanical seal 183 is substantially "U" shaped. Screws 182 secure the element 183 to the window frame. The expansion element of seal 180 does not extend into the mechanical seal in this embodiment. An anchor bolt 184 secured the window frame to the window opening and an interior sealant 186 helps to prevent water from entering the structure.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A flood barrier system in combination with window structures having a frame constructed and arranged for placement within an opening of a structure, said frame having a first and a second sidewall, a top wall and a bottom wall with an impact resistant laminated glass secured thereto, said flood barrier system comprising:

a substantially vertically oriented mechanical seal fastened to an outer surface of each said sidewall of said frame, said substantially vertically oriented mechanical seal having a first surface secured to said frame, a second surface, and a third surface, said third surface being secured to structural walls of said structure, said first and said third surfaces being substantially parallel to each other, said second surface secured to both said first and said third surfaces and spanning a gap formed between said frame and structural walls of the opening of the structure, said first surface, said second surface, and said third surface of said substantially vertically oriented mechanical seal forming a cavity therebetween;

a substantially horizontally oriented mechanical seal fastened to an outer surface of said bottom wall of said frame said substantially horizontally oriented mechanical seal having a first surface secured to said bottom wall of said frame, a second surface, and a third surface, said third surface being secured to a bottom structural wall of said structure, said first and said third surfaces being substantially parallel to each other, said second surface secured to both said first and said third surfaces and spanning a gap formed between said frame and structural walls of the opening of the structure, said first surface, said second surface, and said third surface of said substantially horizontally oriented mechanical seal forming a cavity therebetween;

each said substantially vertically oriented mechanical seal being sealed to said substantially horizontally oriented seal in a watertight manner, thereby forming a water barrier around said window structures; and an expansion element secured within each said cavity of said substantially vertically oriented and substantially horizontally oriented mechanical seals, wherein said expansion elements expand upon the presence of flood waters and seal said frame to said building to prevent the passage of the flood waters, said mechanical seal maintaining said expansion element in a predetermined position when flood waters and the attendant water pressure is present.

2. The flood barrier system according to claim 1 wherein said expansion element has a swelling capacity, wherein a wetted expansion element swells in size at least 100% over a non-wetted expansion element.

3. The flood barrier system according to claim 2 wherein said expansion element is substantially polyurethane.

4. The flood barrier system according to claim 1 wherein said mechanical seals are substantially V-shaped.

5. The flood barrier system according to claim 1 wherein said mechanical seals are flexible and retain a memory shape.

6. The flood barrier system according to claim 1 wherein each said vertically oriented mechanical seal is formed integral to an outer surface of said sidewalls of said frame.

7. The flood barrier system according to claim 1 wherein said mechanical seals are substantially U-shaped having a mounting wall and a first and second support wall extending perpendicular thereto, said expansion element secured between said first second support wall.

8. The flood barrier system according to claim 1 wherein said frame and said mechanical seals are formed from extruded aluminum.

9. The flood barrier system according to claim 1 wherein said mechanical seals are formed from spring steel.

10. The flood barrier system according to claim 1 wherein said mechanical seals are formed from plastic.

11. The flood barrier system according to claim 1 wherein said mechanical seals are concealed between said frame and said building by a caulk sealant.

12. The flood barrier system according to claim 1 including a flood panel secured to an outside of a front of said window structure, said flood panel being substantially watertight.

13. A flood barrier system in combination with a window having a frame constructed and arranged for placement within an opening of a structure, said frame having a first and a second sidewall, a top wall and a bottom wall with an impact resistant laminated glass secured thereto, said flood barrier system comprising:

a substantially vertically oriented mechanical seal fastened to an outer surface of each said sidewall of said frame, said substantially vertically oriented mechanical seal having a first surface secured to said frame, a second surface, and a third surface, said third surface being secured to structural walls of said structure, said first and said third surfaces being substantially parallel to each other, said second surface secured to both said first and said third surfaces and spanning a gap formed between said frame and structural walls of the opening of the structure, said first surface, said second surface, and said third surface of said substantially vertically oriented mechanical seal forming a cavity therebetween;

a substantially horizontally oriented mechanical seal fastened to an outer surface of said bottom wall of said frame said substantially horizontally oriented mechanical seal having a first surface secured to said bottom wall of said frame, a second surface, and a third surface, said third surface being secured to a bottom structural wall of said structure, said first and said third surfaces being substantially parallel to each other, said second surface secured to both said first and said third surfaces and spanning a gap formed between said frame and structural walls of the opening of the structure, said first surface, said second surface, and said third surface of said substantially horizontally oriented mechanical seal forming a cavity therebetween; and each said substantially vertically oriented mechanical seal being sealed to said substantially horizontally oriented seal in a watertight manner, thereby forming a water barrier around said window structures, wherein said substantially vertically oriented and said substantially horizontally oriented mechanical seals expand upon the presence of flood waters and seal said frame to said building to prevent the passage of the flood waters when flood waters and the attendant water pressure is present.

14. The flood barrier system according to claim 13 wherein said mechanical seals are substantially V-shaped.

15. The flood barrier system according to claim 13 wherein said mechanical seals are flexible and retain a memory shape.

16. The flood barrier system according to claim 13 wherein each said vertically oriented mechanical seal is formed integral to an outer surface of said sidewalls of said frame.

17. The flood barrier system according to claim 13 wherein said mechanical seals are substantially U-shaped having a mounting wall and a first and second support wall extending perpendicular thereto.

18. The flood barrier system according to claim 13 wherein said frame and said mechanical seals are formed from extruded aluminum.

19. The flood barrier system according to claim 13 wherein said mechanical seals are formed from spring steel.

20. The flood barrier system according to claim 13 wherein said mechanical seals are formed from plastic.

21. The flood barrier system according to claim 13 wherein said mechanical seals are concealed between said frame and said building by a caulk sealant.

22. The flood barrier system according to claim 13 including a flood panel secured to an outside of a front of said window structure, said flood panel being substantially watertight.

* * * * *